US010561222B2

(12) United States Patent
Delia et al.

(10) Patent No.: US 10,561,222 B2
(45) Date of Patent: Feb. 18, 2020

(54) ROTARY AIRLESS COMPACT

(71) Applicant: Toly Management Ltd., Zejtun (MT)

(72) Inventors: Mario Delia, Zabbar (MT); Paul Adams, Tarxien (MT); Philippe Parker, Attard (MT); Brian McNamara, Mosta (MT); James Attard Kingswell, Attard (MT)

(73) Assignee: TOLY MANAGEMENT LTD., Zejtun (MT)

( * ) Notice: Subject to any disclaimer, the term of this patent is extended or adjusted under 35 U.S.C. 154(b) by 464 days.

(21) Appl. No.: 15/453,323

(22) Filed: Mar. 8, 2017

(65) Prior Publication Data

US 2017/0172284 A1 Jun. 22, 2017

Related U.S. Application Data

(63) Continuation-in-part of application No. 15/262,048, filed on Sep. 12, 2016, now Pat. No. 10,299,563.

(60) Provisional application No. 62/219,765, filed on Sep. 17, 2015.

(51) Int. Cl.

| | |
|---|---|
| ***A45D 33/02*** | (2006.01) |
| ***A45D 40/00*** | (2006.01) |
| ***A45D 40/22*** | (2006.01) |
| ***A45D 42/02*** | (2006.01) |

(52) U.S. Cl.

CPC ..... *A45D 40/0075* (2013.01); *A45D 40/22* (2013.01); *A45D 40/222* (2013.01); *A45D 42/02* (2013.01); *A45D 2040/224* (2013.01); *A45D 2200/051* (2013.01)

(58) Field of Classification Search

CPC ..... A45D 4/0075; A45D 4/00; A45D 4/02; A45D 4/22; A45D 2200/05; A45D 2200/051; A45D 40/0075; A45D 40/00; A45D 40/02; A45D 40/22

USPC ..... 222/207, 214

See application file for complete search history.

(56) References Cited

U.S. PATENT DOCUMENTS

| | | | |
|---|---|---|---|
| 4,982,751 | A | 1/1991 | Oishi et al. |
| 2003/0127105 | A1 | 7/2003 | Fontana |
| 2017/0354234 | A1 | 12/2017 | Streeter |

*Primary Examiner* — Rachel R Steitz

(74) *Attorney, Agent, or Firm* — Wissing Miller LLP

(57) ABSTRACT

A rotary airless compact including facing concentric arcuate inner and annular outer walls which are manually rotatable relative to each other, and a flexible tube extending between the walls and secured to the inner wall. The outer wall has radial ribs projecting inwardly to crimp the tube at spaced locations against the inner wall, providing successive seals between which the tube has internally open regions for holding fluid product. As the outer wall rotates relative to the inner wall in a direction from a first to a second end of the tube, product is drawn from a supply pouch at the first end into successive open regions of the tube in discrete quantities separated by the seals, and the ribs advance the seals and open regions to the second end, where a nozzle or other dispensing element discharges the quantities of product into a pan area of the compact.

6 Claims, 30 Drawing Sheets

FIG 21
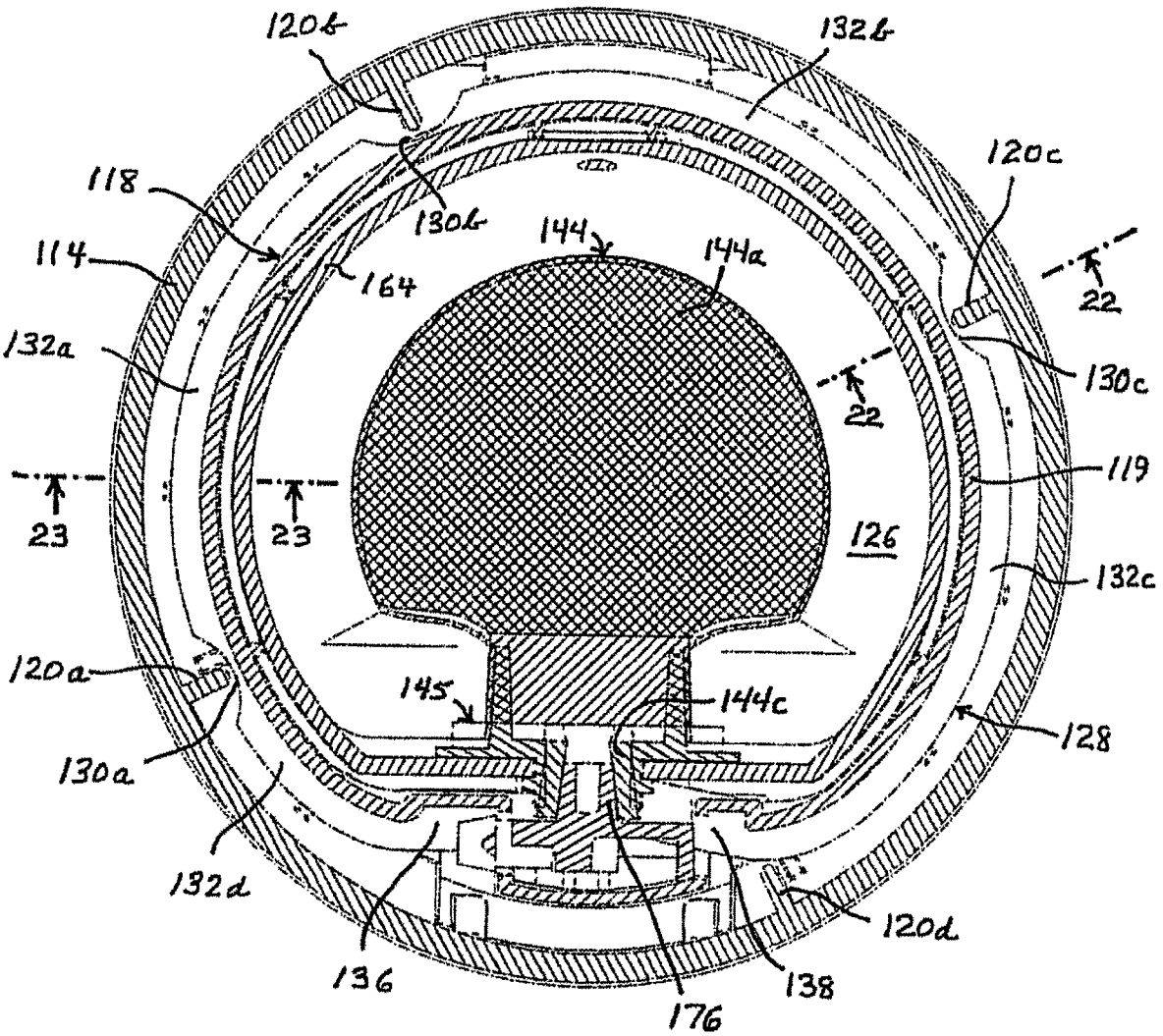
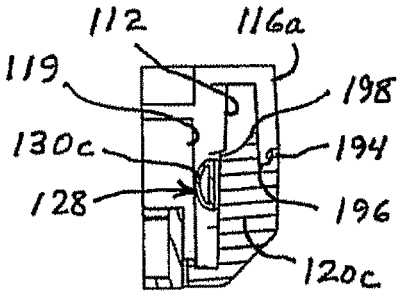
FIG 22
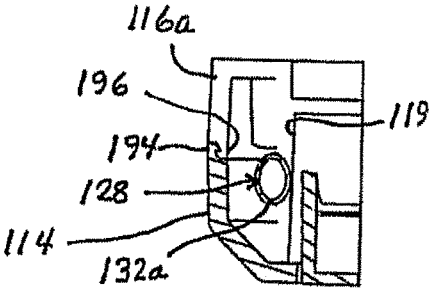
FIG 23

ROTARY AIRLESS COMPACT

CROSS REFERENCE TO RELATED APPLICATION

This application is a continuation-in-part of U.S. patent application Ser. No. 15/262,048, filed Sep. 12, 2016, which claims the benefit, under 35 U.S.C. § 119(e)(1), of U.S. provisional patent application No. 62/219,765 filed Sep. 17, 2015. The entire disclosures of both of the aforesaid applications are incorporated herein by this reference.

BACKGROUND OF THE INVENTION

This invention relates to compacts for holding and dispensing fluid cosmetic and skin care products. In particular, it is directed to a rotary airless compact.

Fluid (e.g., liquid) cosmetic and skin care products are commonly packaged, for sale to end users, in compacts of a size appropriate to be carried in a handbag or pocket and to be comfortably held in a user's hand for application of the contents to the skin. Low cost and ease of manipulation by the user when removing and applying product are desirable attributes of such a compact, as is the provision of accessories including a mirror and sponge or other applicator contained within the compact.

Many of these products are packaged in "airless" containers for protection from exposure to air, in order to reduce contamination and thereby lengthen product lifetime. Advantageously, the product should not only be held in a sealed container when sold, but should be dispensed from the container by the user (in successive quantities or doses for application) while the remaining undispensed body of product in the container is protected against exposure to the atmosphere, and against escape of volatile ingredients.

Fitting an airless system into a cosmetic compact container of generally conventional dimensions, however, has been difficult. Many of the systems heretofore proposed have not afforded an effective seal, have been inconveniently large in size, and/or have involved a large number of components, adding to cost and operating complexity.

The increasing sophistication and sensitivity of higher-performance liquid cosmetic and skin care formulations enhances the importance of providing protection against air exposure in containers for such products, and the need to inhibit egress of volatile product ingredients.

SUMMARY OF THE INVENTION

An object of the invention is to provide an airless compact, for holding and dispensing fluid cosmetic and skin care products and the like, which effectively provides enclosure of the contained product and dispenses individual application quantities of the product while protecting the remaining body of product against release of volatile ingredients and against exposure to the atmosphere. A further object is to provide a compact of this type which is simple in structure, easy to operate, economical in cost and acceptably small in size. Another object is to provide such a compact containing accessories ordinarily included in compacts, as exemplified by a mirror and a sponge applicator.

To these and other ends, the present invention broadly contemplates the provision of a rotary airless compact for a fluid cosmetic or skin care product comprising a compact body defining a pan area and including facing concentric arcuate inner and annular outer walls which are manually rotatable relative to each other; a flexible tube extending between the walls and secured to the inner wall and having first and second ends with an outlet nozzle or other dispensing means, adjacent the second end, communicating with the pan area, for dispensing fluid product from the tube into the pan area; and a supply pouch for fluid product communicating with a first end of the tube, wherein the outer wall bears spaced radial ribs projecting inwardly to crimp the tube at spaced locations against the inner wall, providing successive seals between which the tube has internally open regions for holding product, such that as the outer wall rotates relative to the inner wall in a direction from the first end of the tube toward the second end of the tube, product is drawn from the supply pouch at the first end into the open regions in discrete quantities separated by the seals, and the ribs advance the seals and product-containing open regions to the second end, where the nozzle or other dispensing means discharges the quantities of product into the pan area.

Conveniently or preferably, the supply pouch is a flexible cartridge, in sealed connection with the first end of the tube, and is exposed externally to atmospheric pressure, so that it collapses progressively as it is evacuated by withdrawal of fluid product into the tube. The compact body comprises a top body part with a pan area-defining upper portion above a lower portion including the arcuate inner wall, and a bottom body part including the rib-bearing annular outer wall. The lower portion of the top body part, including the arcuate inner wall, surrounds a central space wherein the pouch is disposed and secured for rotation with the top body part relative to the bottom body part. The top and bottom body parts are interconnected, e.g. snap-fitted together, in a way that permits their relative rotation, and the outer peripheries of the bottom body part and the upper portion of the top body part may be substantially identical in diameter.

In particular embodiments, the pan area has a floor through which the dispensing means opens, and a closure member for covering the pan area. The closure member may include a flapper covering the pan area, hinged to the top body part, having a lower surface bearing a pintle for sealingly closing dispensing means such as an outlet nozzle, and also including a latch for holding the flapper in pan area-closing position. A lid may be hinged to the top body part for overlying the flapper, which may be formed with an upwardly open cavity for receiving an applicator for the fluid product, while the inner surface of the lid may bear a mirror. The pan area floor may have a resilient upward bias such that when the latch is released, the flapper pops open.

In an additional embodiment, the compact includes a platform fixedly attached to the inner wall and extending outwardly around the inner wall; the inner wall laterally surrounds the pan area and is fixedly connected to the pan floor; the outer wall is rotatably mounted on the platform in spaced and surrounding concentric relation to the inner wall and is manually graspable and rotatable relative to the platform and the inner wall; and the tube is disposed between the outer and inner walls so as to be crimped against the inner wall by the ribs as aforesaid. A lid, movable between closed and open positions, may be connected to the platform for defining therewith an enclosure surrounding the inner and outer walls and the pan area. In addition, a removable baseplate, slidably connected to the platform on a side of the platform opposite the lid, may define with the platform a space below the pan area, within which the supply cartridge is replaceably mounted in the baseplate.

The platform, the lid and the baseplate, in this embodiment, when assembled in closed relation to each other, may cooperatively define a housing of generally rectangular configuration entirely enclosing the inner and outer walls, the tubing, the pan area and the cartridge. The platform may have an annular groove concentrically surrounding the inner wall, for receiving the tube and the outer wall and in which the outer wall is rotatably mounted. The first and second ends of the tube may extend downwardly through apertures in the platform about 180° apart into the space below the pan area, respectively, for connection with the cartridge and for communication with the pan area.

Further features and advantages of the invention will be apparent from the detailed description set forth below, together with the accompanying drawings.

BRIEF DESCRIPTION OF THE DRAWINGS

FIG. 21 is a schematic cross-sectional view of the bottom body part of FIG. 20 in assembled relation to the top body part of FIG. 17;

FIGS. 22 and 23 are schematic sectional views, respectively taken along lines 22-22 and 23-23 of FIG. 21;

DETAILED DESCRIPTION

Figure 1:
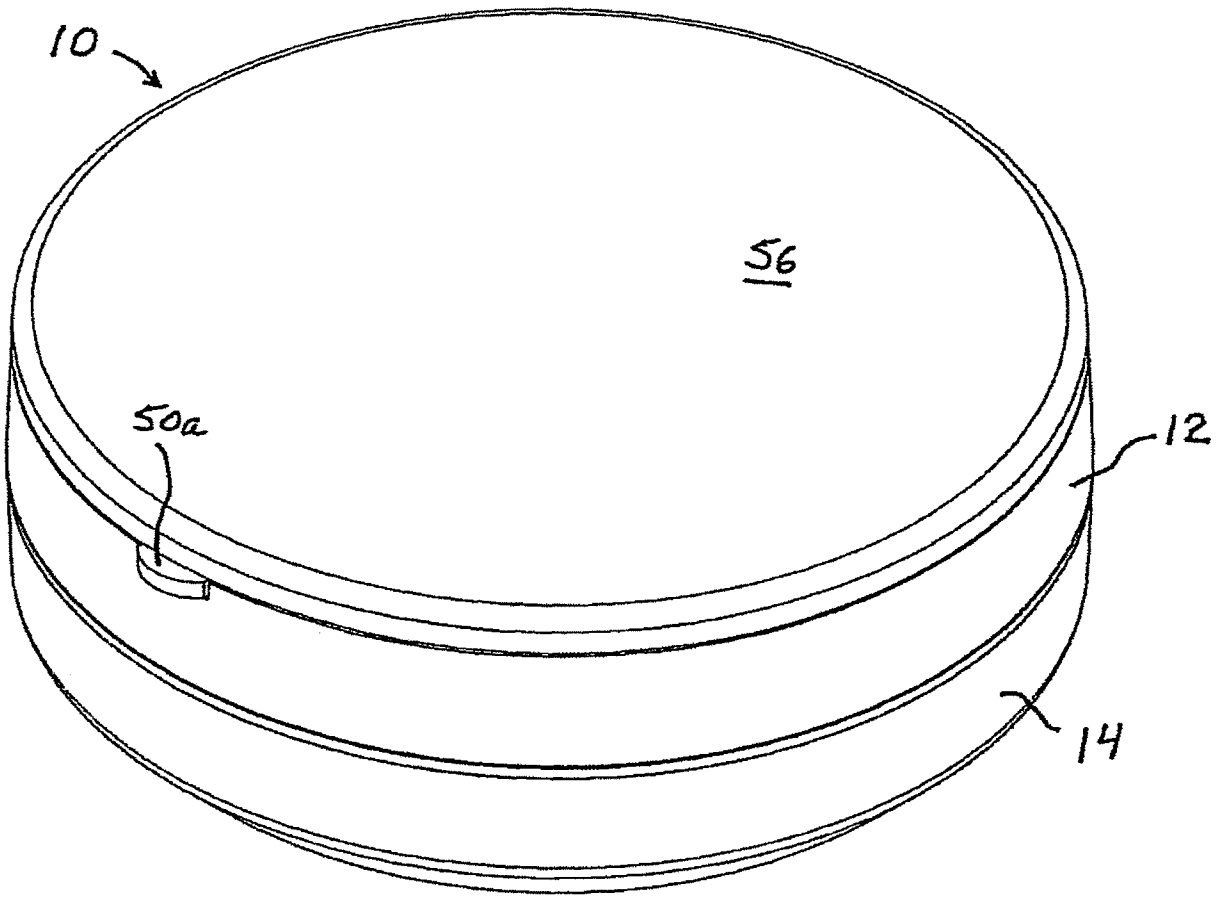
FIG. 1 is a perspective view of a rotary airless compact embodying the present invention in a particular form.
Figure 2:
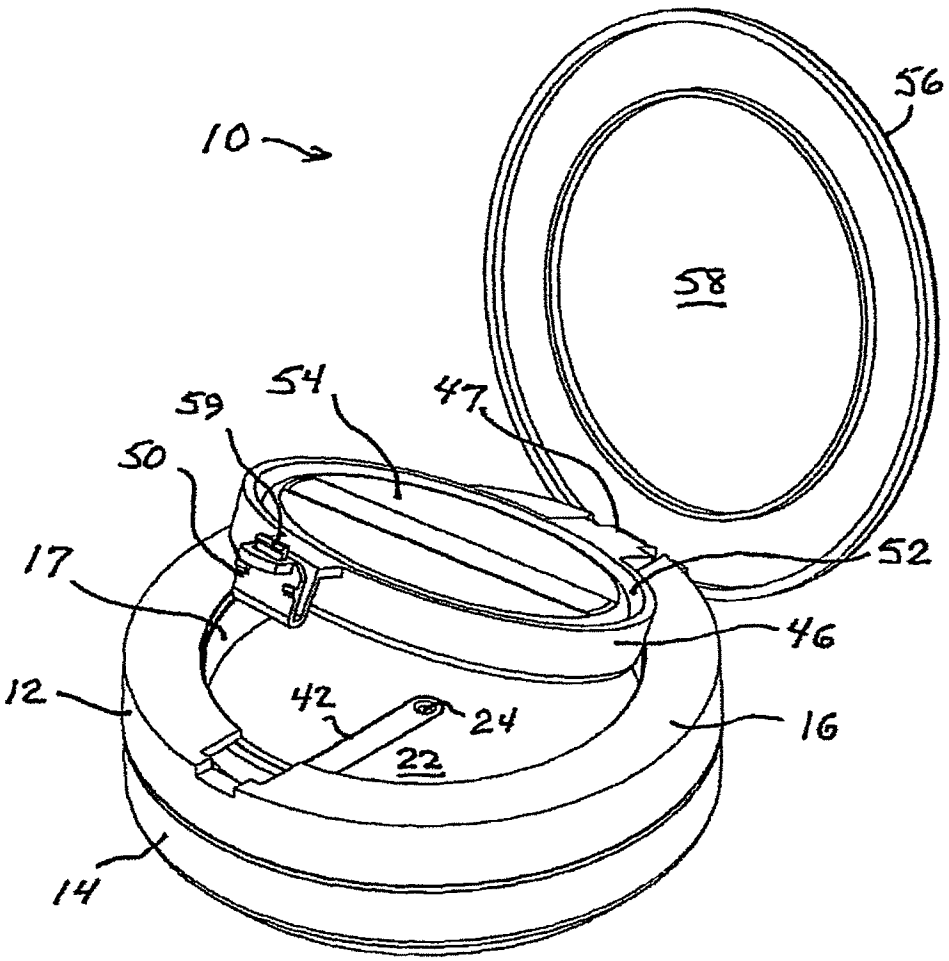
FIG. 2 is a view similar to FIG. 1 showing the lid and flapper raised to expose the pan area of the compact.
Figure 3:
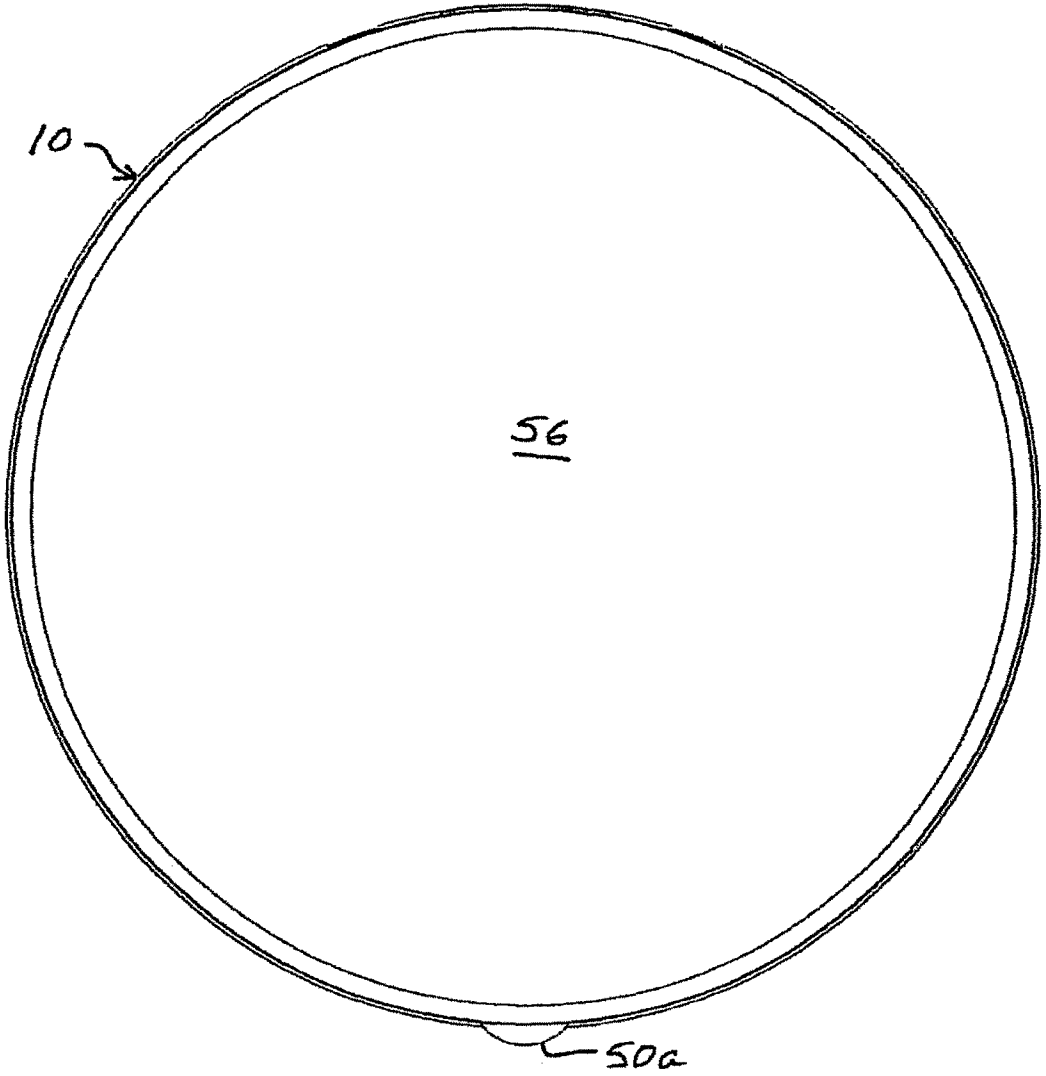
FIG. 3 is a plan view of the top body part of the compact of FIG. 1.
Figure 4:
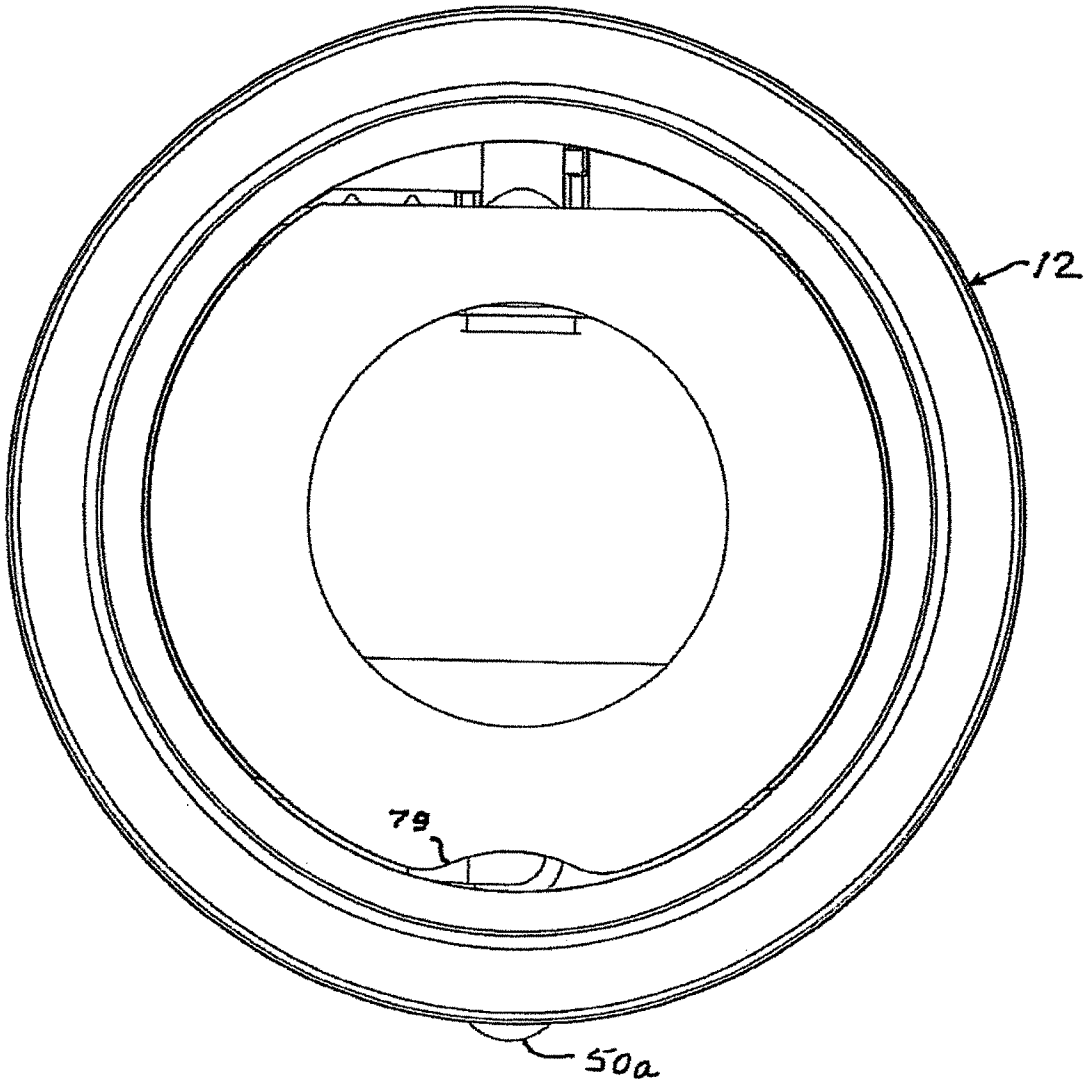
FIG. 4 is a view from below of the top body part.
Figure 5:
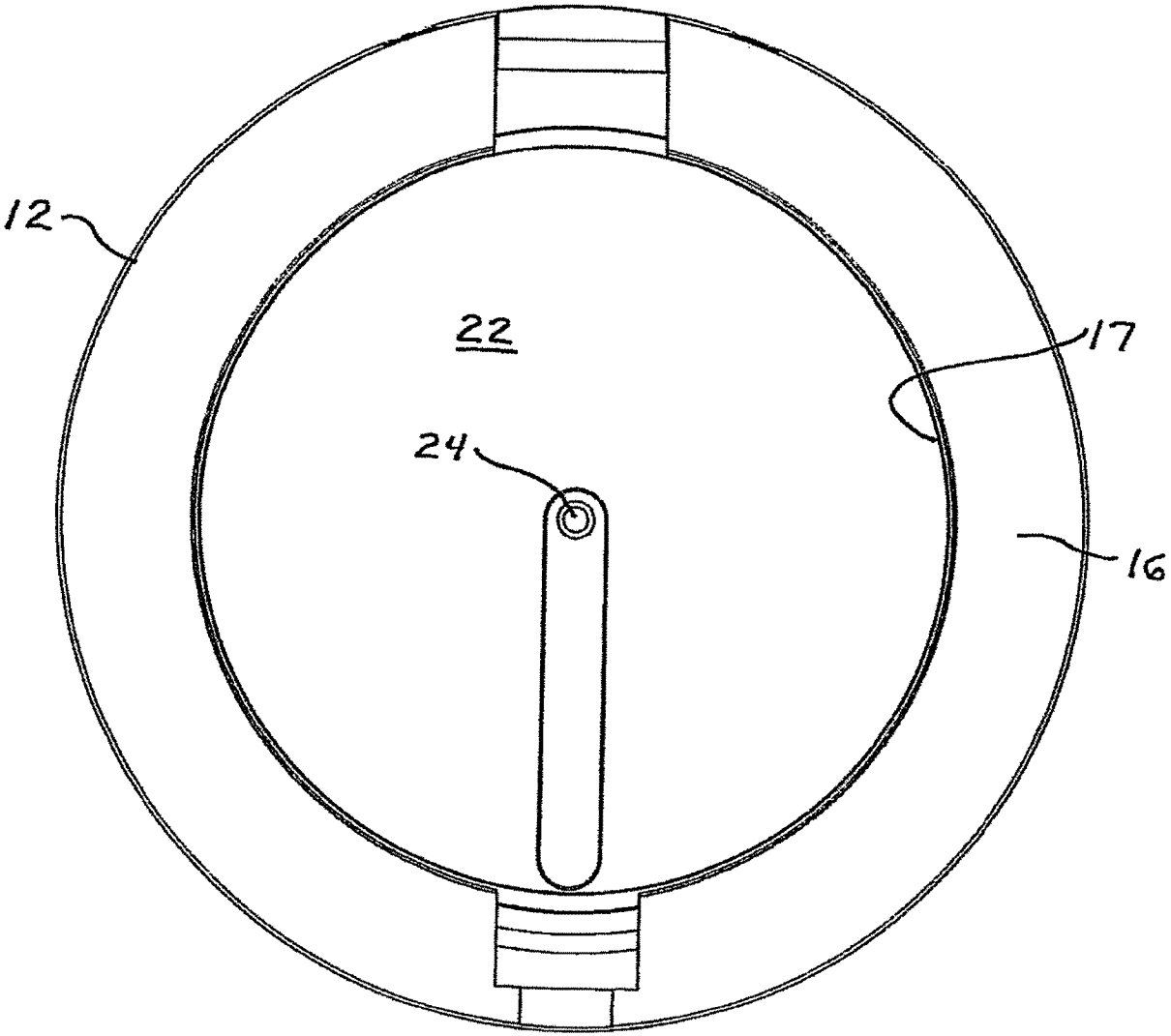
FIG. 5 is a plan view of the top body part of the FIG. 1 compact, with the flapper omitted.
Figure 6:
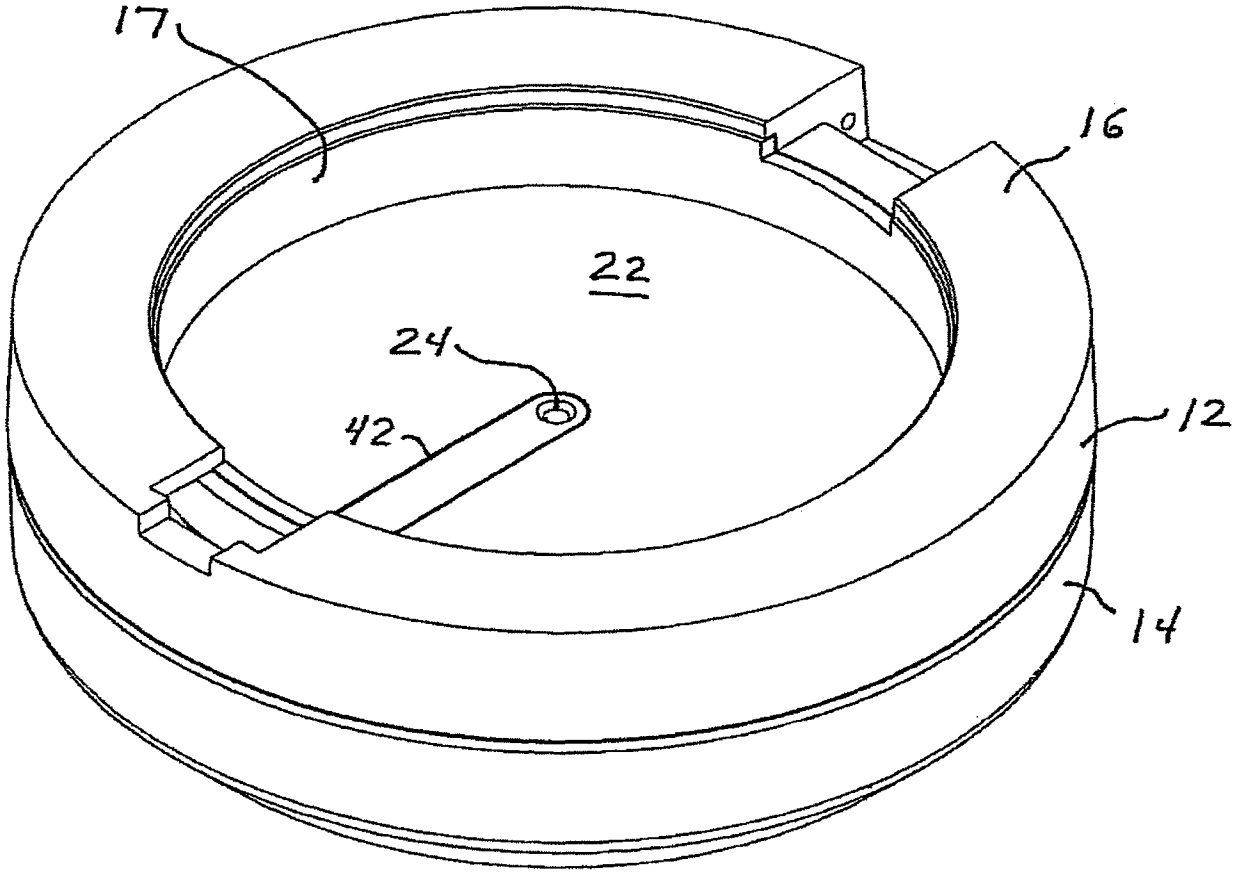
FIG. 6 is a perspective view from above of the top and bottom body parts, assembled together.
Figure 8:
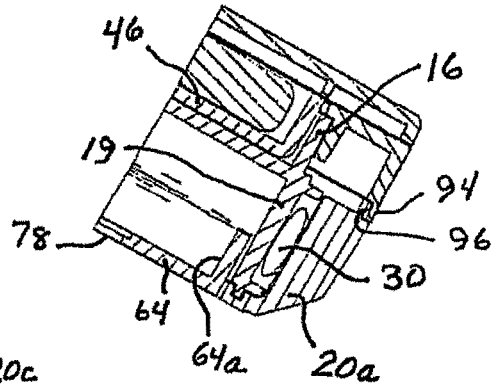
FIGS. 8 and 9 are schematic sectional views, respectively taken along lines 8-8 and 9-9 of FIG. 7, showing the effect of the ribs of the bottom body part in locally sealing the tube as the top and bottom body parts rotate relative to each other.
Figure 7:
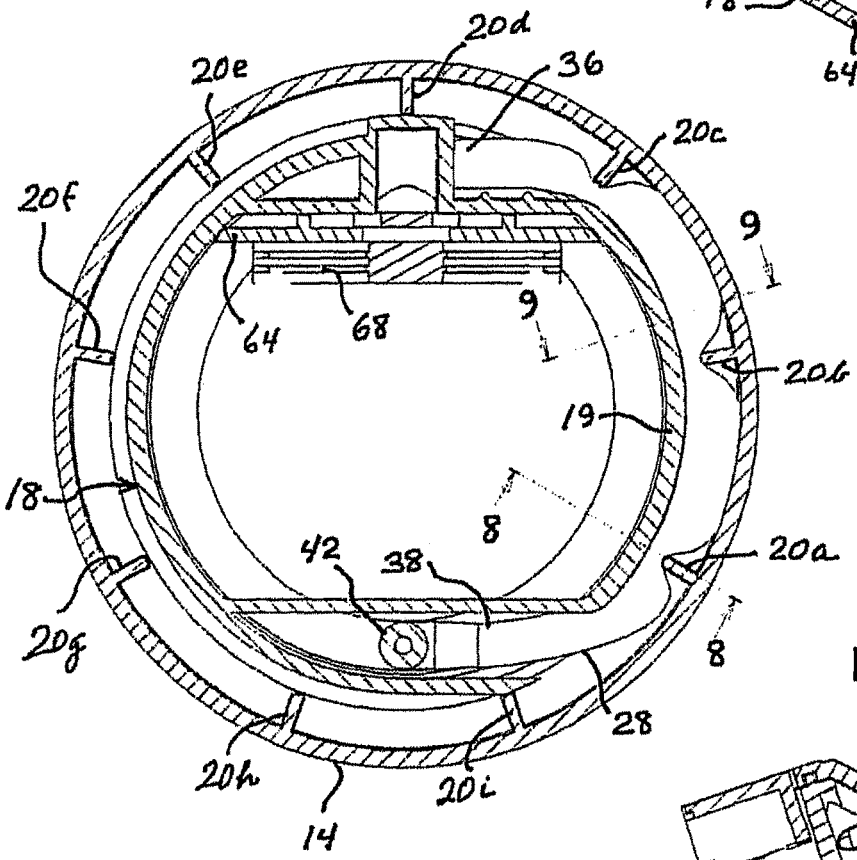
FIG. 7 is a schematic cross-sectional view of the bottom body part of FIG. 6 in assembled relation to the top body part of FIG. 3, illustrating the disposition of the product-containing tube between them.
Figure 9:
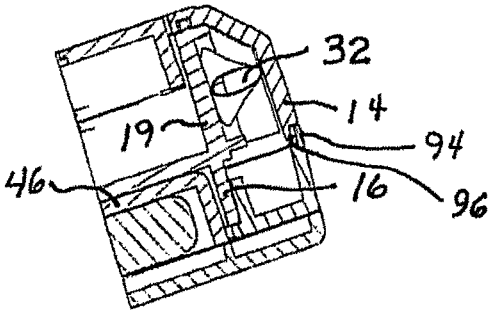
Figure 10:
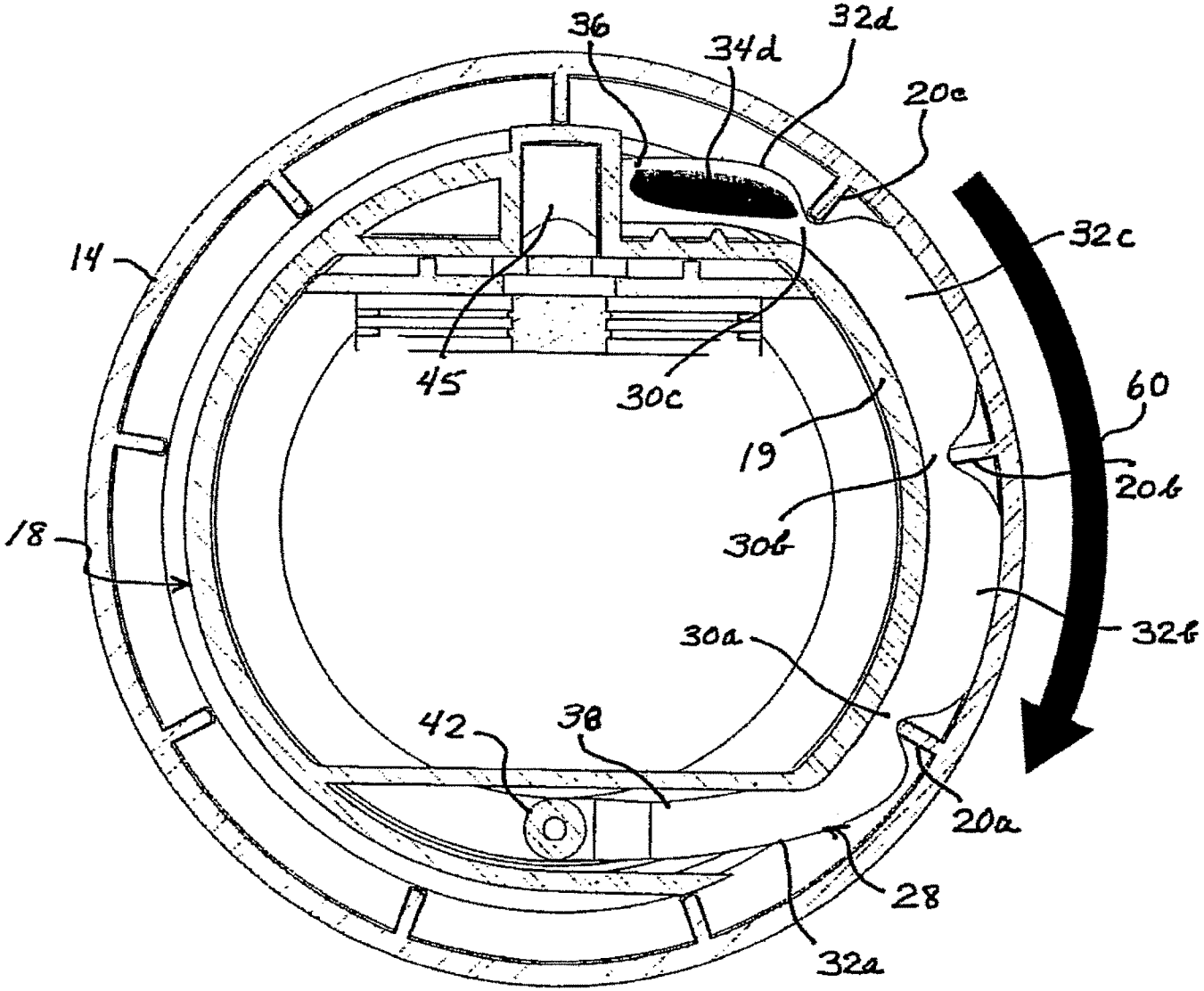
FIGS. 10, 11 and 12 are schematic cross-sectional views similar to FIG. 7, showing successive stages in the operation of the compact to transport fluid product through the tube and dispense quantities of product therefrom.

The embodiment of the invention illustrated in FIGS. 1-14 is a generally disc-shaped rotary airless compact 10 dimensioned to be held in a user's hand, for dispensing a fluid (e.g., liquid) cosmetic or skin care product. This compact 10 comprises a compact body constituted of molded plastic components including a rigid top body part 12 and a rigid bottom body part 14 with substantially circular outer peripheries of the same diameter, snap-fitted together in coaxial relation so as to be manually rotatable relative to each other about their common geometric axis. An upper portion 16 of the top body part defines a central, upwardly opening pan area 17 for holding a quantity of product to be applied by a user. The outer peripheries of the top and bottom body parts are manually graspable for rotating one relative to the other.

Molded integrally with (or otherwise fixedly secured to) the pan area-defining upper portion 16 is a lower portion 18 of the top body part including an arcuate inner wall 19 depending from portion 16 and extending below the pan area into a space laterally surrounded by the bottom body part 14, which itself is an annular wall. Thus, the walls 19 and 14 respectively constitute an arcuate inner wall and an annular outer wall disposed in facing spaced concentric relation and manually rotatable relative to each other. The annular outer wall (bottom body part 14) bears a plurality of angularly spaced truncated radial ribs 20 illustrated as molded integrally therewith, each rib projecting inwardly toward but stopping short of the arcuate inner wall 19; in the embodiment shown, there are nine such ribs 20*a*-20*i*, spaced equidistantly around the inner circumference of the annular outer wall (bottom body part) 14, but this number of ribs is merely exemplary and a larger or smaller number of ribs may be provided. A pan area floor or platform 22, mounted in the top body part 12 within the pan area 17 and having a hole 24 (shown as centrally located in floor 22), separates the pan area from the space 26 below it, which is laterally surrounded by the top body part lower portion 18 including the arcuate inner wall 19.

A soft flexible hollow tube 28 is disposed between the arcuate inner wall 19 and the annular outer wall 14 and extends over an arc (about 180° in the illustrated embodiment) sufficient so that the tube is simultaneously engaged by a plurality (in this case three) of the ribs 20. The ribs are shaped, disposed and dimensioned to compress the tube against the facing inner wall 19, locally crimping the tube and thereby creating a seal 30 (FIG. 8) within the tube at each location of crimping, while the un-crimped regions 32 (FIG. 9) of the tube between adjacent ribs are internally open, for respectively holding discrete quantities 34 of product to be dispensed. For example, if the outer surface of inner wall 19 is a sector of an axially vertical cylinder, the ribs 20 may have vertical straight inner edges so as to compress the tube uniformly against wall 19, and may extend sufficiently close to wall 19 so that the tube, between a rib and the wall, is crimped to form a seal. The rib edges, molded of plastic, are made smooth enough to avoid damage to the tube when the ribs move along and in contact with the tube.

Although the ribs 20 are shown as rigid, solid, fixed structural features molded integrally with the wall 14, they may take other forms. For example, they may be hollow rather than solid and may be non-integral with the wall 14; in an illustrative further alternative, they may be axially vertical rollers rotatably mounted on the inner surface of wall 14. The term "ribs" as used herein is to be understood as embracing all these and other structural features disposed and configured to provide the described compression and crimping of the tube.

Additionally, the tube 28 has a first (inlet) end 36 and a second (outlet) end 38 both fixed to the top body part 12 and disposed in the lower portion 18 thereof; consequently, the tube rotates with the arcuate inner wall 19 and top body part relative to the annular outer wall (bottom body part) 14. The tube outlet end 38 is connected in sealed relation to means for dispensing fluid product from the tube into the pan area, such means being shown as an outlet nozzle 42 fixed (e.g., welded) to the pan area structure; the nozzle opens through the hole 24 of the pan area floor, for discharging quantities of the fluid product into the pan area. The body of fluid product in the compact is contained in a collapsible flexible pouch cartridge 44 disposed within the space 26 and communicating (through a sealed connection 45) with the tube inlet end 36 for supplying fluid product to the tube.

As an alternative to outlet nozzle 42, other means may be employed for dispensing fluid product from the tube through the hole 24 into the pan. For instance, instead of a nozzle, a sponge layer could be disposed at the hole 24 and arranged such that fluid product delivered to the sponge layer from the tube outlet end passes into the pan through the sponge layer at the hole. Also, the hole 24 need not be located at the center of the pan floor.

A closure member exemplified in the illustrated embodiment of the invention by a flapper 46, hinged at 47 to the top body part 12, is shaped and dimensioned to cover the pan area 17 and bears, on its underside, a protruding pintle 48 for sealing the nozzle 42 through the hole 24. A resilient latch or clip 50 (FIGS. 13-14) on the front of the flapper secures it in closed position (FIG. 1), maintaining the pintle forcibly against (and thereby sealing) the opening 24 of nozzle 42; when the clip 50 is opened by manual pressure on protrusion or button 50*a*, opening of the flapper is aided by a small pop-up of the flapper caused by release of the resilient pan area floor from depression by the pintle. As shown, the flapper is formed with an upwardly open cavity 52 for holding a sponge applicator 54. In addition, a lid 56, having an inner surface bearing a mirror 58, is hinged to the top body part 12 and in its closed position overlies the flapper; in the illustrated embodiment, a portion 59 of clip 50 secures the lid to the flapper, such that pressure on button 50*a* successively releases the flapper from the compact body and the lid from the flapper. This enables the flapper to be opened while the lid remains secured to it, for example to retain the applicator between the flapper and the lid (if it is not desired to utilize the applicator for a particular application of the fluid product), and/or to keep both lid and flapper conveniently clear of the pan area while the user is applying product from the pan area.

Alternatively, the compact may simply be provided with a single closure member such as a hinged lid rather than with a separate lid and flapper as described.

The operation of the compact of FIG. 1 may now be readily understood with reference to the schematic illustrations of FIGS. 7-12. In an example of an initial state (FIGS. 7 and 10), before any of the fluid product has been transferred from the pouch cartridge 44 through the inlet end 36 to the tube 28, the arcuate inner and annular outer walls 19 and 14 are stationary relative to each other. Three of the ribs (20*a*, 20*b*, 20*c*) are simultaneously engaging the empty tube and compressing it against the inner wall 19, thereby crimping the tube to create three seals (30*a*, 30*b*, 30*c*) spaced apart along the length of the tube between the outlet end 38 and the inlet end 36 thereof, and respectively separating four successive un-crimped, internally open regions (32*a*, 32*b*, 32*c* and 32*d*) of the tube.

To dispense fluid product, a user grasps the external peripheries of the top and bottom body parts 12 and 14 and rotates one relative to the other in a direction such that the ribs advance along the tube away from the inlet end 36 toward the outlet end 38. This rotation is indicated by arrow 60, which represents the direction (clockwise, in FIGS. 10-12) in which the annular outer wall (bottom body part 14) is turned while the arcuate inner wall 19 and its attached tube 28 are held stationary.

At this point, the open region 32*d* (between seal 30*c* and the inlet end of the tube) is in communication with the fluid product supply pouch cartridge 44, and is filled with a quantity 34*d* of fluid product forced into it from the cartridge by external atmospheric pressure acting on the flexible pouch, because there is a vacuum in any such open region within the sealed tube.

Figure 11:
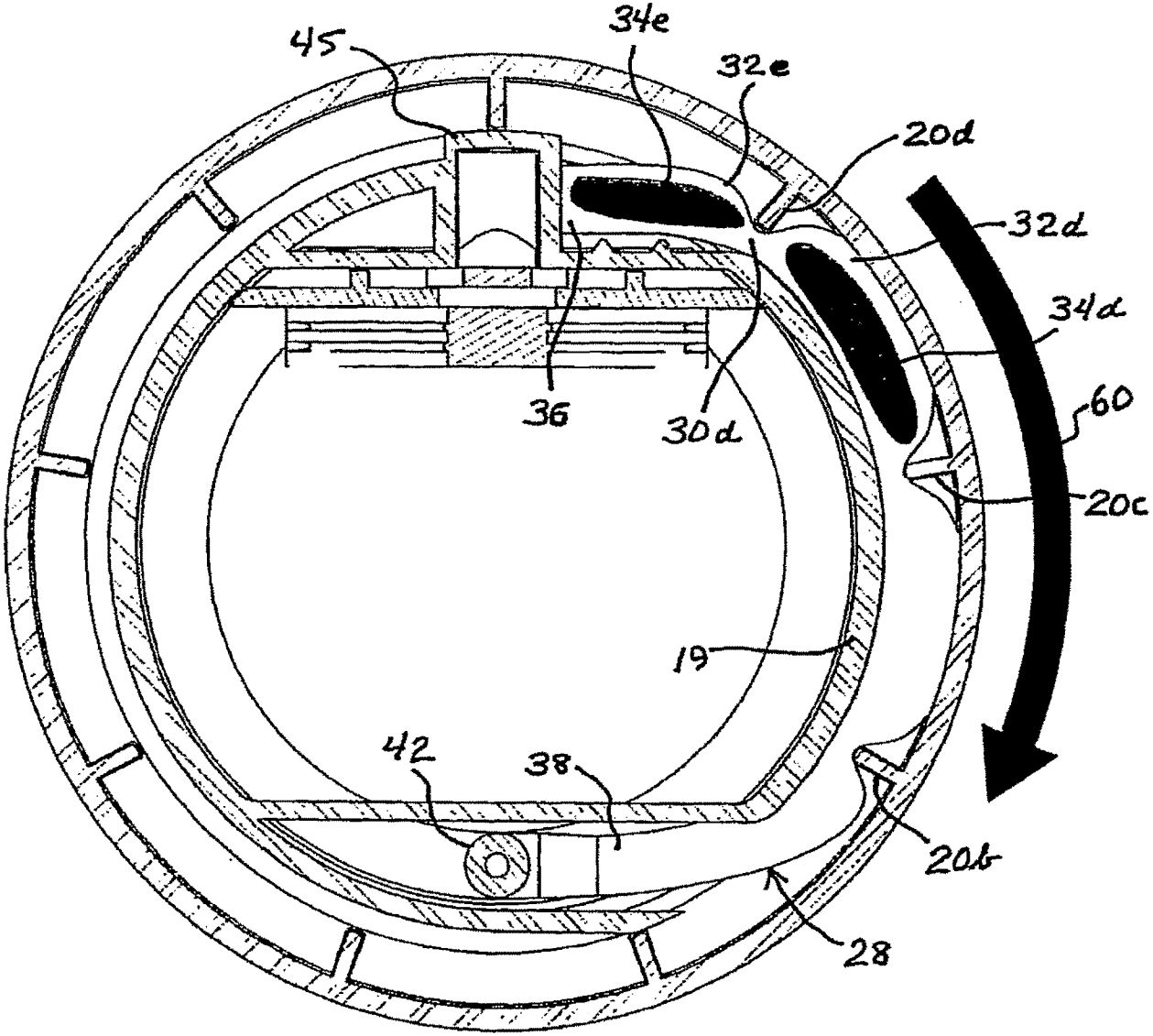

As the rib 20*c* begins to move downstream along the tube, i.e. away from the tube inlet end 36 toward the tube outlet end 38 (FIG. 10), the seal 30*c* moves with it along the tube, so that the tube open region 32*d* progressively elongates internally between the seal 30*c* and the tube inlet end, thereby creating a vacuum which continues to draw fluid product from the pouch cartridge 44 through the tube inlet end into the region 32*d*. Thus product quantity 34*d* continues to fill region 32*d* of the tube until the next adjacent rib 20*d* is rotated into engagement with the tube at the inlet end 36, and compresses the tube against the inner wall 19 to create another seal 30*d* that closes the upstream end of the product-filled tube region 32*d* (FIG. 11). Since the seal 30*c*, moving downstream with rib 20*c* along the tube, closes the downstream end of tube region 32*d*, a discrete quantity 34*d* of product is contained in region 32*d* and is pushed therewith along the tube by rib 20*d* as the ribs rotate in the direction of arrow 60.

Figure 12:
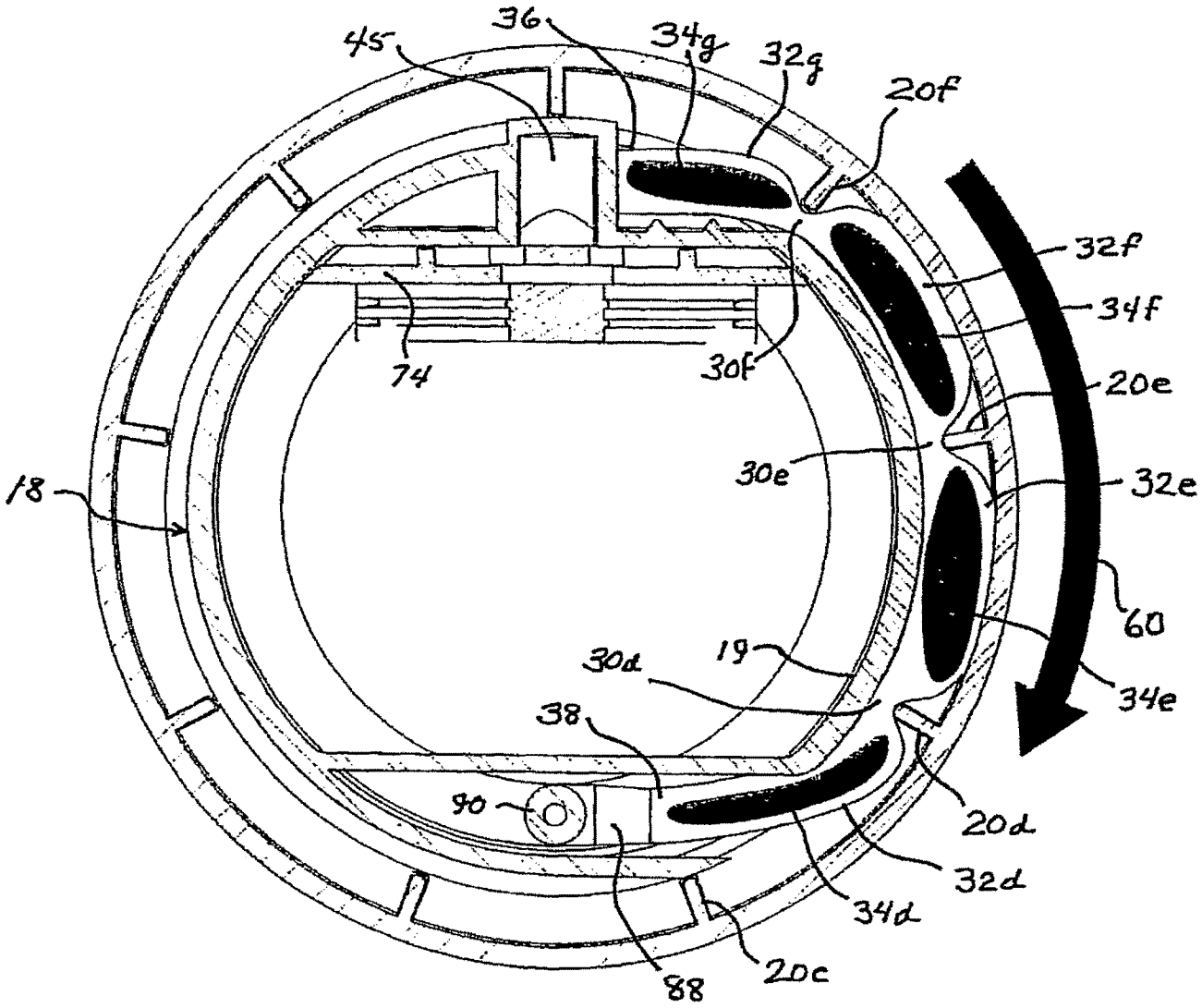
Figure 13:
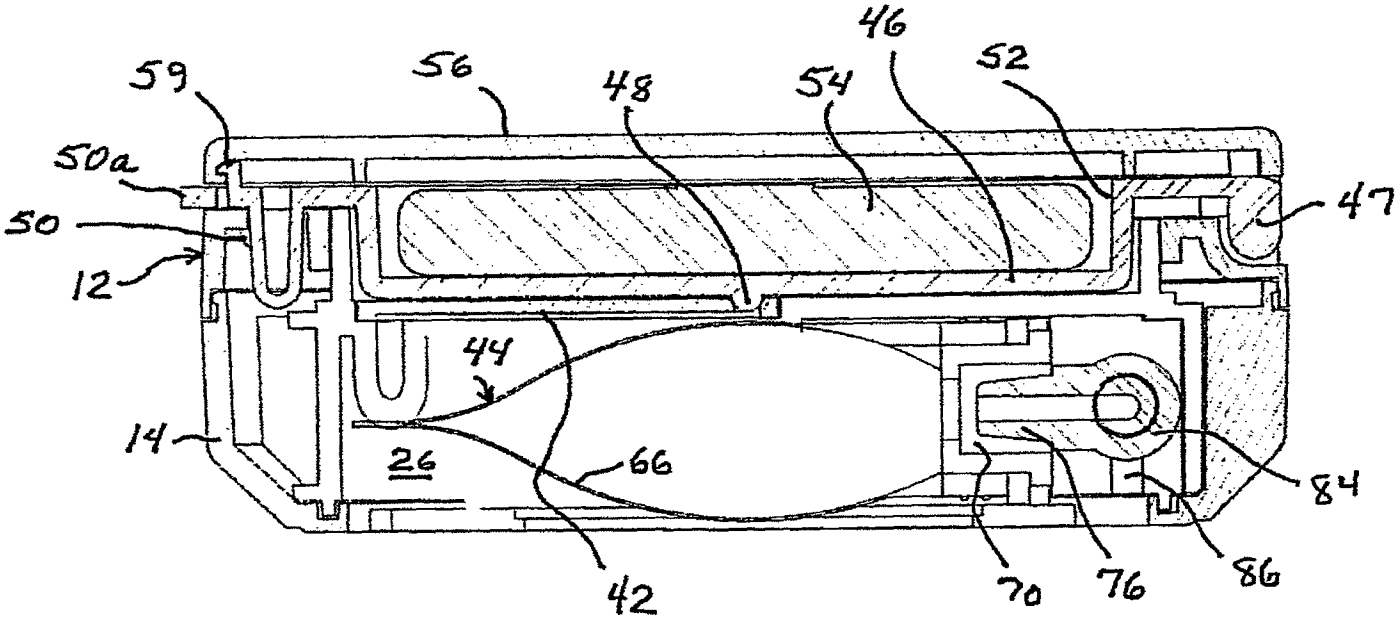
FIGS. 13 and 14 are sectional elevational views of the compact, showing a product-holding pouch cartridge communicating with the inlet of the tube, respectively before and after the product has been dispensed from the pouch.
Figure 14:
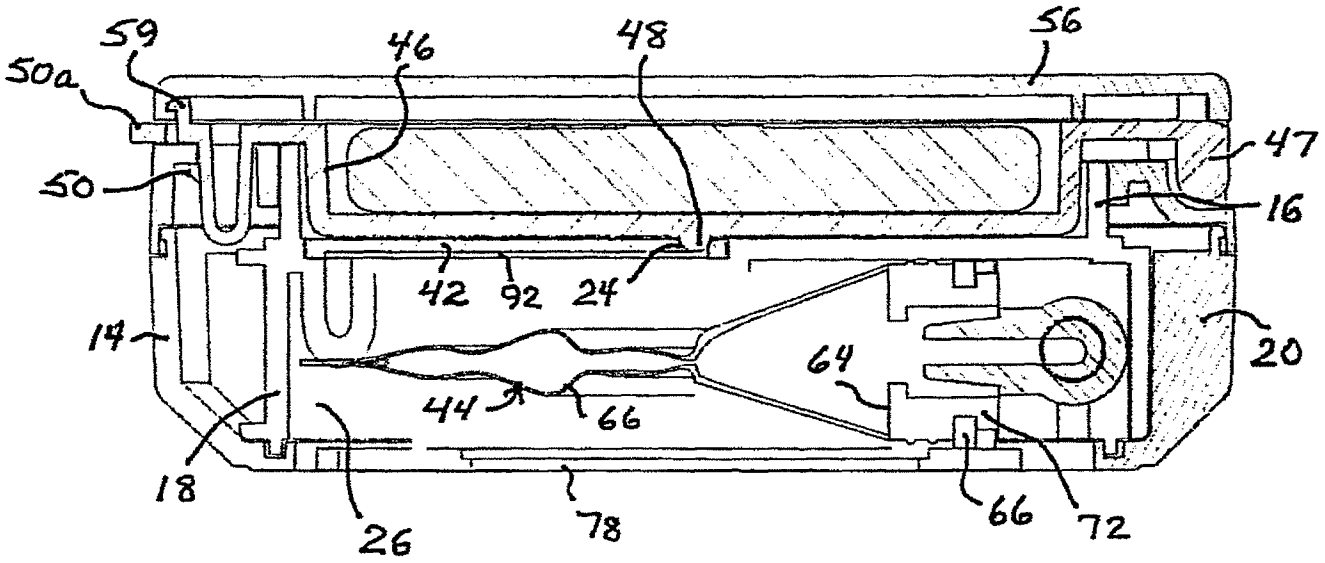
Figure 15:
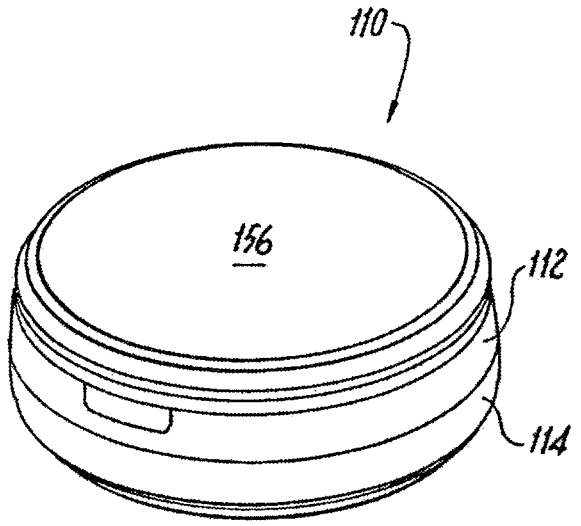
FIG. 15 is a perspective view of another embodiment of the rotary airless compact of the present invention.
Figure 16:
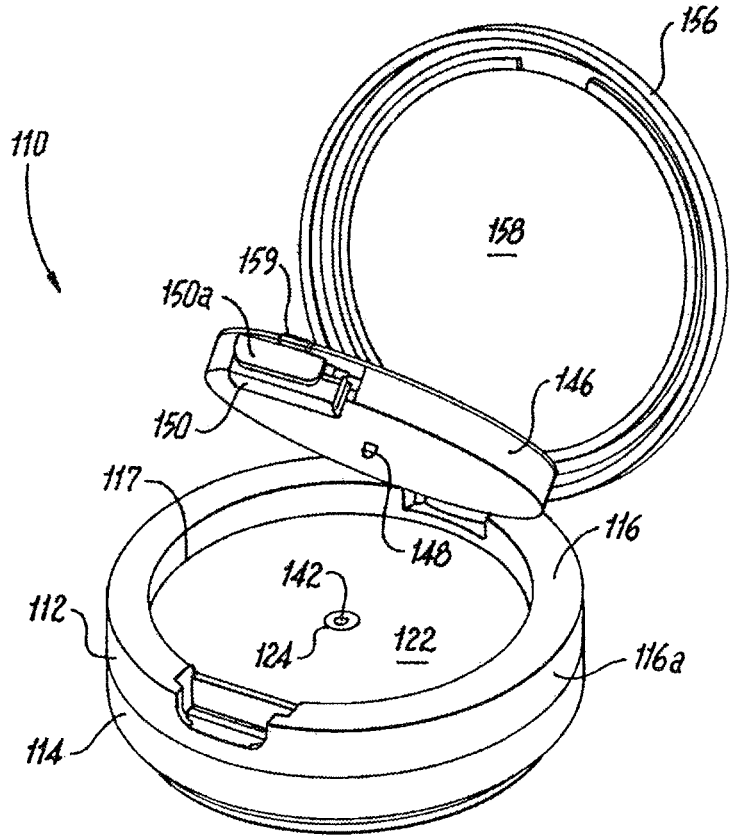
FIG. 16 is a similar view of the compact of FIG. 15 showing the lid and flapper raised to expose the pan area of the compact.
Figure 17:
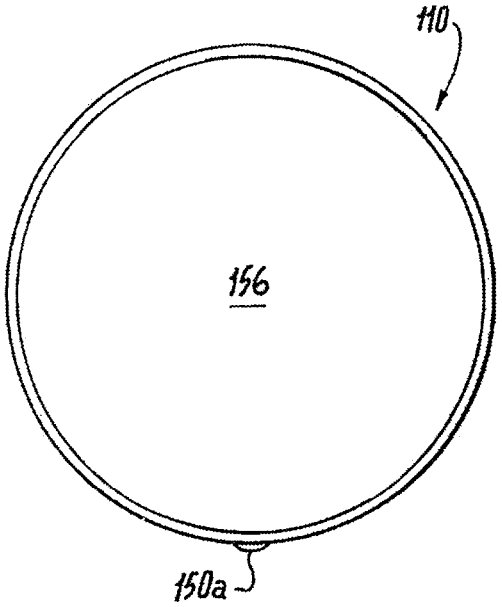
FIG. 17 is a plan view of the top body part of the compact of FIG. 15.
Figure 18:
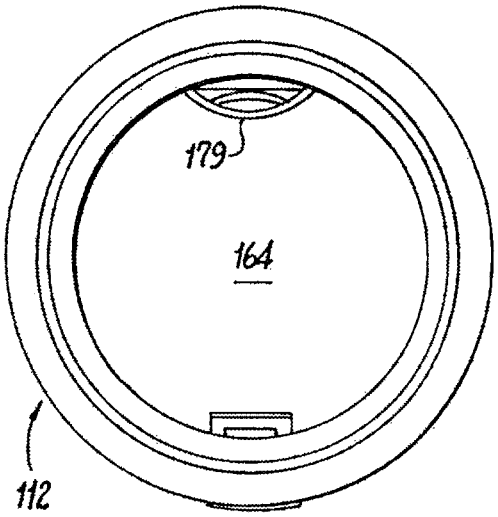
FIG. 18 is a view from below of the top body part of the FIG. 15 compact.
Figure 19:
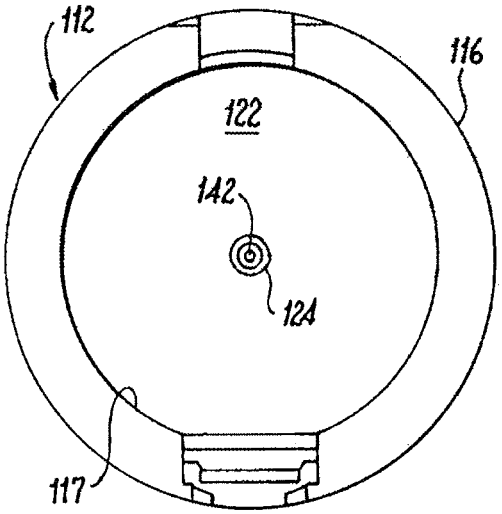
FIG. 19 is a plan view of the top body part of the FIG. 15 compact, with the flapper omitted.
Figure 20:
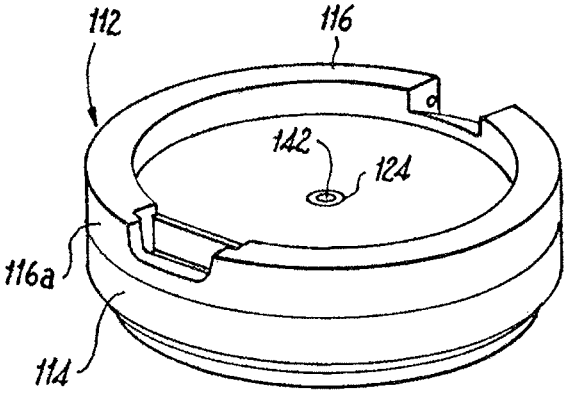
FIG. 20 is a perspective view from above of the top and bottom body parts of the FIG. 15 compact, assembled together.
Figure 24:
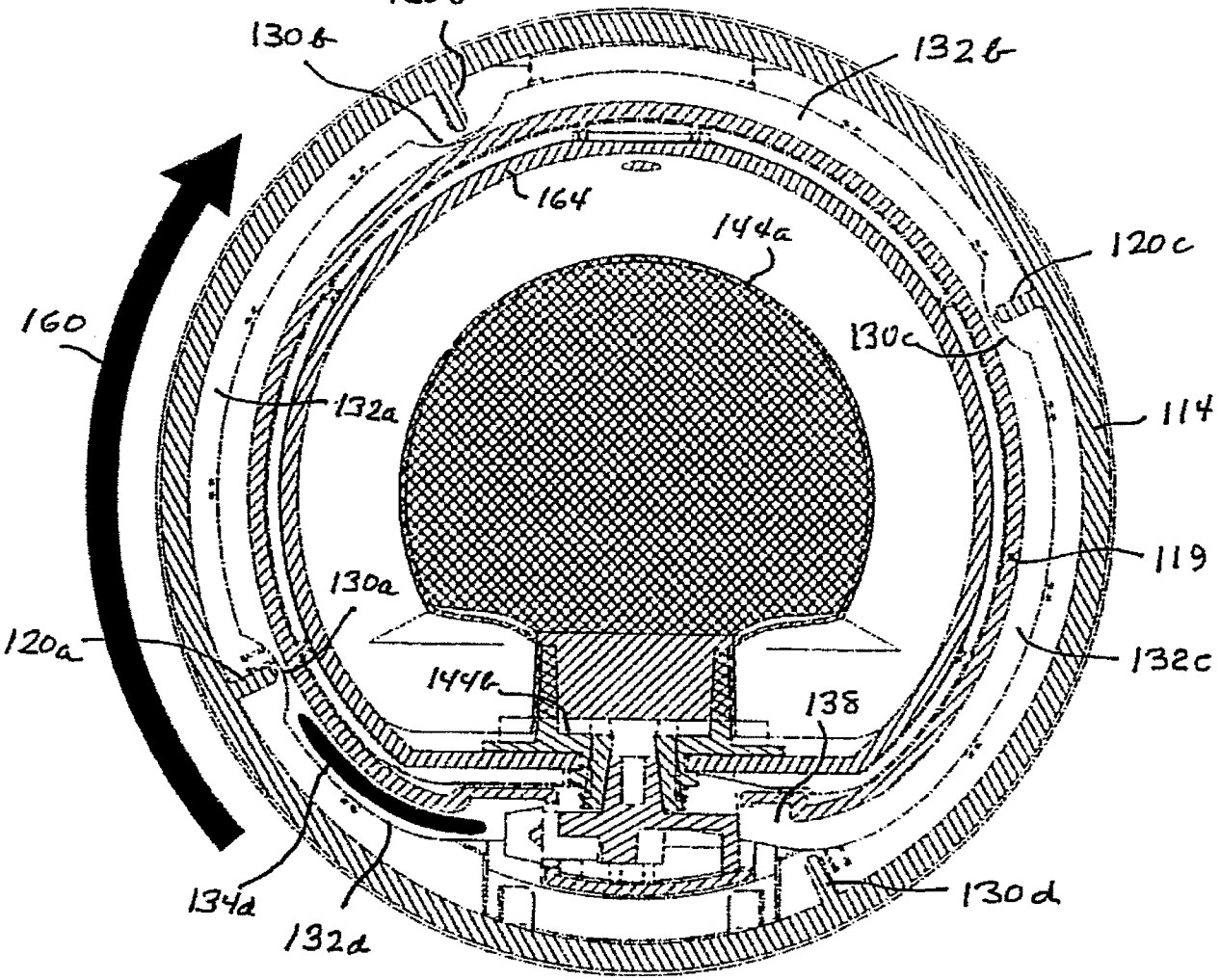
FIGS. 24, 25 and 26 are schematic cross-sectional views similar to FIG. 21, showing successive stages in the operation of the compact of FIG. 15 to transport fluid product through the tube and dispense quantities of product therefrom.

The continuing rotation of wall 14 relative to wall 19 carries the new seal 30*d* downstream along the tube past the inlet end 36, causing a further progressively elongating tube open region 32*e* to open between seal 30*d* and the tube inlet end, again creating a vacuum, which draws a quantity of fluid product 34*e* from cartridge 44 into region 32*e* (FIG. 11). Then, another rib 20*e* advances into engagement with tube 28 at the inlet end; another seal 30*e* is created in the tube, followed (as rib 20*e* advances) by another internally open region 32*f*, filled in its turn by a quantity 34*f* of fluid product from the cartridge 44, while the discrete product quantities 34*d* and 34*e* are moved, by the advancing ribs 20*d* and 20*e*, toward the tube outlet end 38. As rib 20*f* follows, seal 30*f* and internally open tube region 32*g* are created, and region 32*g* is filled with discrete product quantity 34*g* (FIG. 12).

In this way, by simple manual rotation of the bottom body part 14 relative to the top body part 12, successive discrete quantities 34*d*-34*g* of fluid product each in an enclosure (regions 32*d*-32*g*) provided by the tube and the crimped, moving seals 30*c*-30*f*, are advanced by the moving ribs 20 from the inlet end to the outlet end of the tube. At the outlet end, the rotary movement of the ribs forces these discrete product quantities in succession out through the nozzle 42 into the pan area 17, flapper 46 (along with lid 56) having been opened to remove the pintle 48 from the nozzle. The user, employing the sponge applicator 54 (conveniently available in the flapper cavity 52) if desired, picks up the dispensed fluid product from the pan area and, with the aid of mirror 58 on the lid, applies it to the skin.

This procedure may be repeated, for successive applications of the fluid product, as long as there is a dispensable amount of product in the cartridge 44. The cartridge (shown in FIGS. 13 and 14 as including a simple flexible, collapsible pouch communicating with the tube inlet end via connection 45) may be any type of container for fluid that is dimensioned to fit within space 26 and to be carried with the tube by the top body part 12, and is adapted to discharge fluid product into the tube each time a vacuum is created at the tube inlet end by a moving rib 20 as described above, until the body of fluid product it contains is at least substantially exhausted. As fluid product is drawn from the flexible pouch 44, the pouch is progressively evacuated and consequently progressively collapsed by ambient atmospheric pressure acting on the exterior of the pouch; i.e., the differential between external ambient pressure and the vacuum created at the tube inlet end by an advancing rib 20 acts to force remaining fluid product from the pouch into an internally open region 32 of the tube until the next advancing rib crimps the tube to form another seal 30 at the inlet end.

The amount of fluid product to be dispensed for a single application depends on the extent of rotation of the bottom body part 14 relative to the top body part 12, and the resultant number of discrete quantities 34 of product discharged into the pan area; hence, such amount can readily be varied by a user. Once the compact begins to be used, and the initial amount desired for an application has been dispensed, a succession of discrete quantities 34 of the product will remain standing in the tube (see FIG. 12), each individually contained within a region 32 of the tube closed at both ends by seals 30. This standing series of undispensed discrete product quantities in the tube does not compromise product quality or lifetime, because the enclosed product quantities in the tube are protected from exposure to the atmosphere or other contact with air, owing to the tube walls and the maintained seals 30 at each end of each product-filled region 32. The remaining body of product in the cartridge 44 is also protected from the atmosphere because the cartridge is itself sealed as is the connection of the cartridge to the tube, and the succession of seals 30 within the tube prevents any access of air to the cartridge through the tube.

Between applications, the nozzle 42 is sealed by the pintle. In particular embodiments of the invention, the compact may include arrangements (to which, however, the invention in its broader aspects is not limited) for preventing any relative rotation of the top and bottom body parts while the pan area is closed and/or for limiting such relative rotation, even when the pan area is open, to the one direction in which fluid product is advanced from the inlet end toward the outlet end of the tube. Relative rotation of the top and bottom body parts while the nozzle is sealed may, for instance, be avoided by providing a structural feature on the bottom of the flapper that engages with ribs 20 of the bottom body part 14 to prevent such rotation whenever the flapper is clipped in the pan area-closing position. As one example of an arrangement for preventing wrong-way relative rotation, an internal ratchet that engages with the upright ribs may be provided to ensure that the top and bottom body parts can be rotated relative to each other only in a direction for pumping fluid out through the nozzle and thus that no air can be pumped back into the compact by relative rotation in the opposite direction.

The dosing volume can be varied by appropriate selection of such parameters as the number and spacing angle of the ribs and the inner and outer diameters of the tube. In addition, the height of the external peripheries of the top and bottom body parts, and their surface contours, may be selected to assist in gripping and provide decorative effects if desired.

In an exemplary and currently preferred arrangement, to which however the invention in its broader aspects is not limited, in the illustrated embodiment of the compact of the invention, the pouch cartridge may be adapted to be removable by the user when empty and replaceable with a refill cartridge. Such a cartridge may include a rigid plastic component secured with a seal to the flexible pouch and insertable therewith into a cartridge holder or baseplate that seats in portion 18 of the top body part 12. This component and portion 18 have mating coupling nozzle structures that inter-fit to provide a maintained seal between the cartridge and the tube inlet end while defining a passage therethrough for fluid product.

More particularly, the pouch cartridge 44 may be received within a rigid molded plastic panel holder or baseplate 64 that seats removably in the open bottom end of the lower portion 18 of the top body part 12 so as to rotate therewith relative to the bottom body part 14. The baseplate 64 has an upwardly opening cartridge-receiving recess 64*a* with a plan configuration conforming to that of the space 26. The cartridge 44 comprises a flexible bag or pouch 66 constituted of foil and polymer layers heat-sealed together to contain a body of fluid product, the pouch being shaped and dimensioned to fit within recess 64*a* in space 26, and a rigid molded plastic component 68 including a wide tapered cartridge nozzle 70, to which the pouch is heat-sealed. The cartridge nozzle 70 has a lip 72 around its opening. After the pouch is filled with fluid product through nozzle 70, a soft seal of tubing or an O-ring (not shown) is placed inside the nozzle, and the nozzle is plugged by a stopper (also not shown); the seal and stopper together keep the nozzle 70 sealed during transport and handling of the cartridge.

To insert the cartridge into the compact, a user removes the baseplate 64 from the bottom end of portion 18 of body part 12 and slides the nozzle lip 72 between upright walls 74 on the baseplate 64, thereafter removing the stopper while grasping the baseplate; the tubing or O-ring nozzle seal remains in place. The user then slides the cartridge-containing baseplate into the open lower end of portion 18 of body part 12 such that an intake nozzle 76 fixedly mounted in portion 18 enters the cartridge nozzle 70 and is forced against the seal in the cartridge nozzle as the baseplate is fully inserted in the lower end opening of portion 18. The intake nozzle 76 in the illustrated embodiment has a taper which, with a complementary taper at the opening of the cartridge nozzle 70, combined with the tubing or O-ring seal, provides a tapered fit that serves to maintain a seal since the back of the baseplate is restrained in a forward position when fitted into the open bottom of portion 18.

As the compact containing the cartridge is employed to dispense fluid product, a window 78 in the base plate enables the user to check the remaining product volume in the pouch (which is preferably transparent). After the contents of the pouch have been exhausted, the baseplate is removed from the compact, e.g. manually, such removal being facilitated by a small cutout 79 in the baseplate; thereby the intake nozzle 76 and pouch nozzle 70 are disengaged and the empty cartridge is extracted, advantageously by re-inserting the aforementioned stopper in the cartridge nozzle and using it to pull the cartridge up and out of the baseplate. A refill cartridge (identical to cartridge 44) can now be inserted in the compact, following the procedure described above. Throughout these operations, the flexible bag or pouch itself need not be touched by the user, so that there is no accidental premature discharge of product from the pouch.

The intake nozzle 76, which opens radially (toward the geometric axis of the compact top and bottom body parts), has an output fitting 84 that extends (at about 90° to nozzle 76) generally tangentially within the compact periphery and is inserted into the inlet end 36 of tube 28. Upright walls 86 press the tube inlet end portion against the fitting 84 so as to hold the tube inlet end firmly and fixedly within the lower portion of the top body part 12.

The outlet nozzle 42 (diametrically opposed to the intake nozzle 76 in the illustrated embodiment of the invention) has a non-tapered entry portion 88 opening generally tangentially of the compact periphery. The outlet end 38 of tube 28 is fitted over this entry portion 88, which allows the tube outlet end some freedom to slip forwardly and retract, as desired in the illustrated embodiment to accommodate movement imparted to the tube as the ribs 20 pass along the tube during rotation of outer wall 14 relative to inner wall 19, while maintaining the tube end 38 connected to the portion 18 of body part 12. From outlet nozzle entry portion 88, a vertical portion 90 of the nozzle conveys fluid product upwardly to a channel portion 92 (open-topped, but sealed by welding to the pan area floor) that directs the fluid product to hole 24.

In the embodiment illustrated, the tube 28 extends about 180° around the common geometric axis of the top and bottom body parts 12, 14, and the arcuate inner wall 19 that cooperates with the ribs 20 to create seals 30 in the tube has an angular extent about that axis only sufficient to form three such seals at a time; the remainder of the lower portion 18 of the top body part 12 is a continuation of the arcuate wall, interrupted for the connections of the tube inlet and outlet ends to the cartridge 44 and the nozzle 42 respectively. Other embodiments may have different extents of tube and arcuate wall; for instance, the tube may extend almost a full 360° around the aforesaid common geometric axis, with its inlet and outlet ends secured to a combined nozzle fixture (not shown) that includes an intake nozzle connected to the cartridge with an output inserted in the tube inlet end, and an outlet nozzle inserted in the tube outlet end and having a channel connected to pan area hole 24.

One such other embodiment is exemplified by the compact 110 shown in FIGS. 15-27, of which FIGS. 15-26 respectively correspond to FIGS. 1-12. The compact 110 is generally similar in dimensions, configuration, structure and operation to the above-described compact 10 except as specifically explained below. It comprises a compact body made of molded plastic components including a rigid top body part or platform 112 and a rigid bottom body part or base 114 with substantially circular outer peripheries of the same diameter, snap-fitted together in coaxial relation so as to be manually rotatable relative to each other about their common geometric axis. An upper portion 116 of the top body part defines a central, upwardly opening pan 117 for holding a quantity of product to be applied by a user, and has a depending outer skirt 116*a* that interengages with an upper edge region of the bottom body part 114 to provide the snap-fitting connection of the two body parts, as hereinafter further described.

The top body part 112 also has a lower portion 118 including an arcuate inner wall 119 depending from portion 116 inwardly of skirt 116*a* and extending below the pan into a space laterally surrounded by the bottom body part 114, which is itself an annular wall. Thus, the walls 119 and 114 respectively constitute an arcuate inner wall and an annular outer wall disposed in facing spaced concentric relation and manually rotatable relative to each other. In the compact 110, the arcuate inner wall 119 as well as the annular outer wall (bottom body part) 114 extends in a continuous curve almost entirely around the aforesaid common geometric axis, unlike the counterpart wall 19 of the above-described compact 10. The annular outer wall 114 bears four truncated radial ribs 120*a*, 120*b*, 120*c*, 120*d* (once more shown as rigid solid plastic features molded integrally therewith) and equiangularly spaced (90° apart) around the inner circumference of the annular outer wall 114, each rib projecting inwardly toward but stopping short of the arcuate inner wall 119. The floor 122 of the pan 117, having a hole 124 (shown as, but not necessarily, centrally located in the pan floor), separates the pan area from the space 126 below it, which is laterally surrounded by the top body part lower portion 118 including the arcuate inner wall 119.

A soft flexible hollow tube 128 is disposed between the arcuate inner wall 119 and the annular outer wall 114 and extends almost 360° around the wall 119 (unlike the tube 28 of compact 10, which extends over an arc of only about 180°), being always simultaneously engaged by at least three of the four ribs 120*a*-120*d*. Conveniently or preferably, this tube is made of synthetic tubing such as Tygon®, Viton® or nitrile rubber tubing, selected for mechanical characteristics such as surface friction and compression set and for compatibility with cosmetic formulations to be contained in the compact (in contrast to silicone tubing, for instance, as to which there are compatibility problems with certain cosmetic formulations that may contain hydrocarbon solvents). Tygon® tubing, being less stretchable than some other tubing, does not creep forward when subjected to dragging forces by the ribs and therefore does not tend to form kinks toward the tube outlet end. One specific example of suitable commercially available tubing is Tygon® E-3603 tubing, owing to low surface friction, good compatibility with cosmetic formulations and ease of compression.

The ribs 120*a*-120*d* are shaped, disposed and dimensioned to compress the tube against the facing inner wall 119, each rib locally crimping the tube so as to create a seal 130*a*, 130*b*, 130*c* or 130*d* (FIGS. 21, 22 and 24-26) within the tube at each location of crimping, while the un-crimped regions 132*a*, 132*b*, 132*c* and 132*d* (FIGS. 21, 23 and 24-26) of the tube between adjacent ribs are internally open, for respectively holding discrete quantities or "doses" 134*a*, 134*b*, 134*c* and 134*d* (FIG. 26) of product to be dispensed. In this embodiment, again, the rib edges, molded of plastic, are made sufficiently smooth to avoid damage to the tube when the ribs move along and in contact with the tube.

Additionally, the tube 128 has a first (inlet) end 136 and a second (outlet) end 138 both fixed to the top body part 112; hence the tube rotates with the arcuate inner wall 119 and top body part relative to the annular outer wall (bottom body part) 114. This relative rotation causes the ribs to move along the length of tube 128 in a direction from the inlet end to the outlet end of the tube, correspondingly causing seals 130*a*-130*d*, un-crimped regions 132*a*-132*d* and product quantities ("doses") 134*a*-134*d* to advance along the tube in the same direction. The tube outlet end 138, in compact 110, turns and extends inwardly of wall 119 beneath the pan floor 122 to a right-angle output dispenser piece 140 having a first end 141 sealingly received in tube end 138 and a central output nozzle 142 snapped into the hole 124 in the center of the pan floor, for discharging successive doses of cosmetic product from the tube into the pan. The body of fluid product in the compact is contained in a collapsible flexible pouch cartridge 144 disposed within the space 126 and communicating (through a sealed connection 145) with the tube inlet end 136 for supplying fluid product to the tube.

The pouch in this embodiment has a nozzle that is wider in diameter and thus easier to fill (owing to changes in overall compact geometry) than that of the first-described embodiment, and the volume of the pouch has also been increased, by enlarging its area and incorporating gussets or folds along its bottom or sides.

A closure member or flapper 146, hinged at 147 to the top body part 112, covers the pan 117 and bears, on its underside, a protruding pintle 148 for sealing the output nozzle 142 fitted in the hole 124. A resilient latch or clip 150 (releasable by button 150*a*) on the front of the flapper secures it in closed (pan-covering) position, maintaining the pintle forcibly against (and thereby sealing) the opening of nozzle 142. The flapper has an upwardly open cavity 152 for holding a sponge applicator. Also hinged to the top body part is a lid 156 which bears a mirror 158 and, when closed, overlies the flapper; a portion 159 of clip 150 secures the lid to the flapper, such that manual pressure on button 150*a* successively releases the flapper from the compact body and the lid from the flapper.

The operation of the compact 110 to deliver fluid cosmetic product from the pouch cartridge 144 to the pan 117 is, as stated, essentially similar to that of the compact 10, described above, and is illustrated schematically in FIGS. 24-26. In a near-initial state (FIG. 24), before any of the fluid product has been transferred from the pouch cartridge 144 through the tube 128 to the pan 117, three of the ribs (120*a*, 120*b*, 120*c*) are simultaneously engaging the empty tube and compressing it against the inner wall 119, thereby crimping the tube to create three seals (130*a*, 130*b*, 130*c*) spaced apart along the length of the tube between the outlet end 138 and the inlet end 136 thereof, and respectively separating four successive un-crimped, internally open regions (132*a*, 132*b*, 132*c* and 132*d*) of the tube. The fourth rib, 120*d*, is located adjacent the tube outlet end 138, where the tube turns inwardly toward dispenser piece 140, and is thus out of contact with the tube.

To dispense fluid product, a user grasps the external peripheries of the top and bottom body parts 112 and 114 and rotates one relative to the other in a direction such that the ribs advance along the tube away from the inlet end 136 toward the outlet end 138, as indicated by arrow 160, which represents the direction (clockwise, in FIGS. 24-26) in which the annular outer wall (bottom body part) 114 is turned while the top body part including arcuate inner wall 119 and its attached tube 128 are held stationary.

At this point, the open region 132*d* (between seal 130*a* and the inlet end of the tube) is in communication with the fluid product supply pouch cartridge 144, and is being filled with a quantity 134*d* of fluid product forced into it from the cartridge by external atmospheric pressure acting on the flexible pouch, because there is a vacuum in any such open region within the sealed tube. None of the other internally open regions 132*a*-132*c* yet contains any fluid product.

Figure 25:
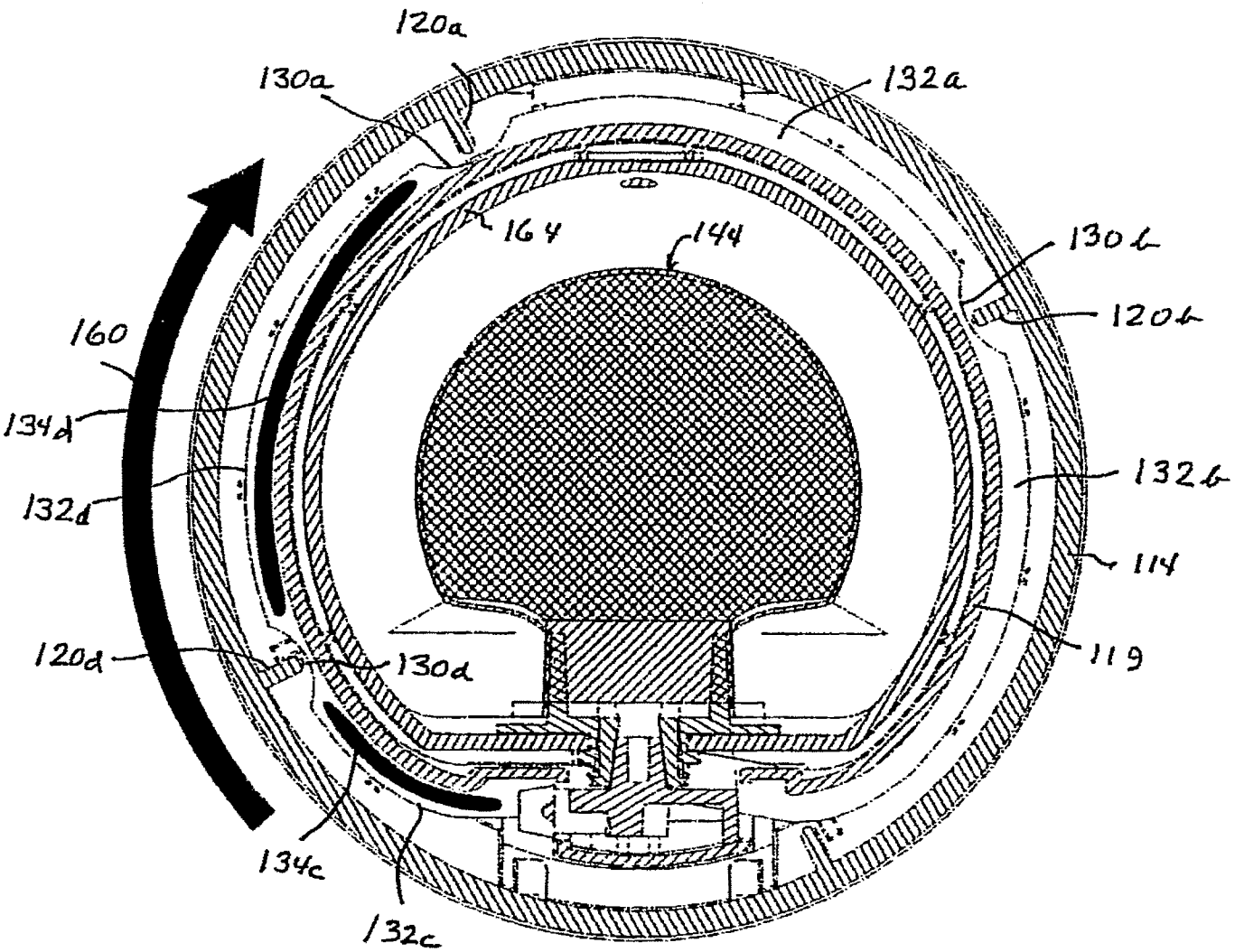

As the rib 120*a* begins to move downstream along the tube, away from the tube inlet end 136 toward the tube outlet end 138 (FIG. 24), the seal 130*a* moves with it along the tube, so that the tube open region 132*d* progressively elongates internally between the seal 130*c* and the tube inlet end, thereby creating a vacuum which continues to draw fluid product from the pouch cartridge 144 through the tube inlet end into the region 132*d*. Thus product quantity 134*d* continues to fill region 132*d* of the tube until the next adjacent rib 120*d* is rotated into engagement with the tube just beyond the inlet end 136, and compresses the tube against the inner wall 119 to create another seal 130*d* that closes the upstream end of the product-filled tube region 132*d* (FIG. 25). Since the seal 130*a*, moving downstream with rib 120*a* along the tube, closes the downstream end of tube region 132*d*, a discrete quantity or dose 134*d* of product is contained in region 132*d* and is pushed therewith along the tube by rib 120*d* as the ribs rotate in the direction of arrow 160.

Figure 26:
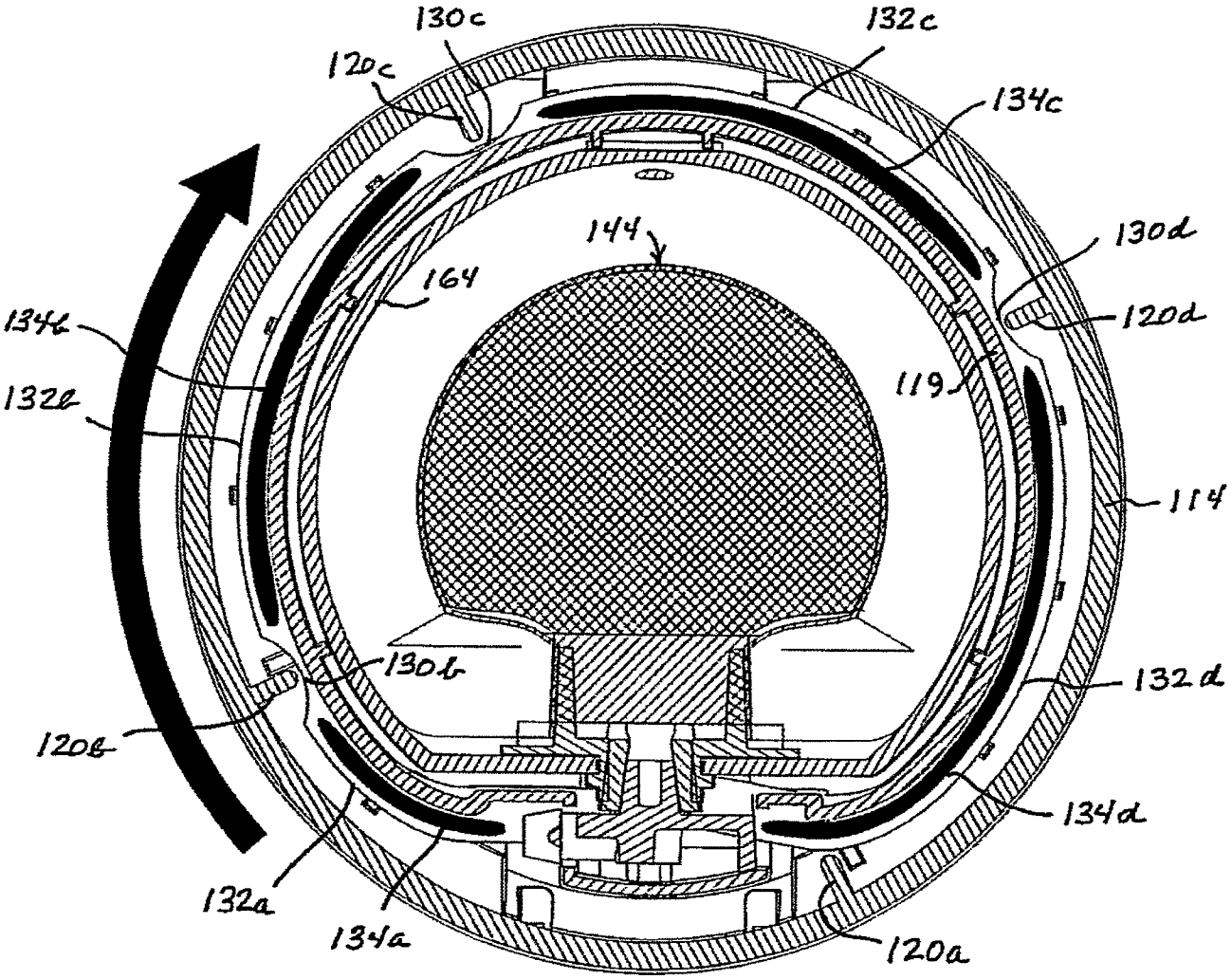
Figure 27:
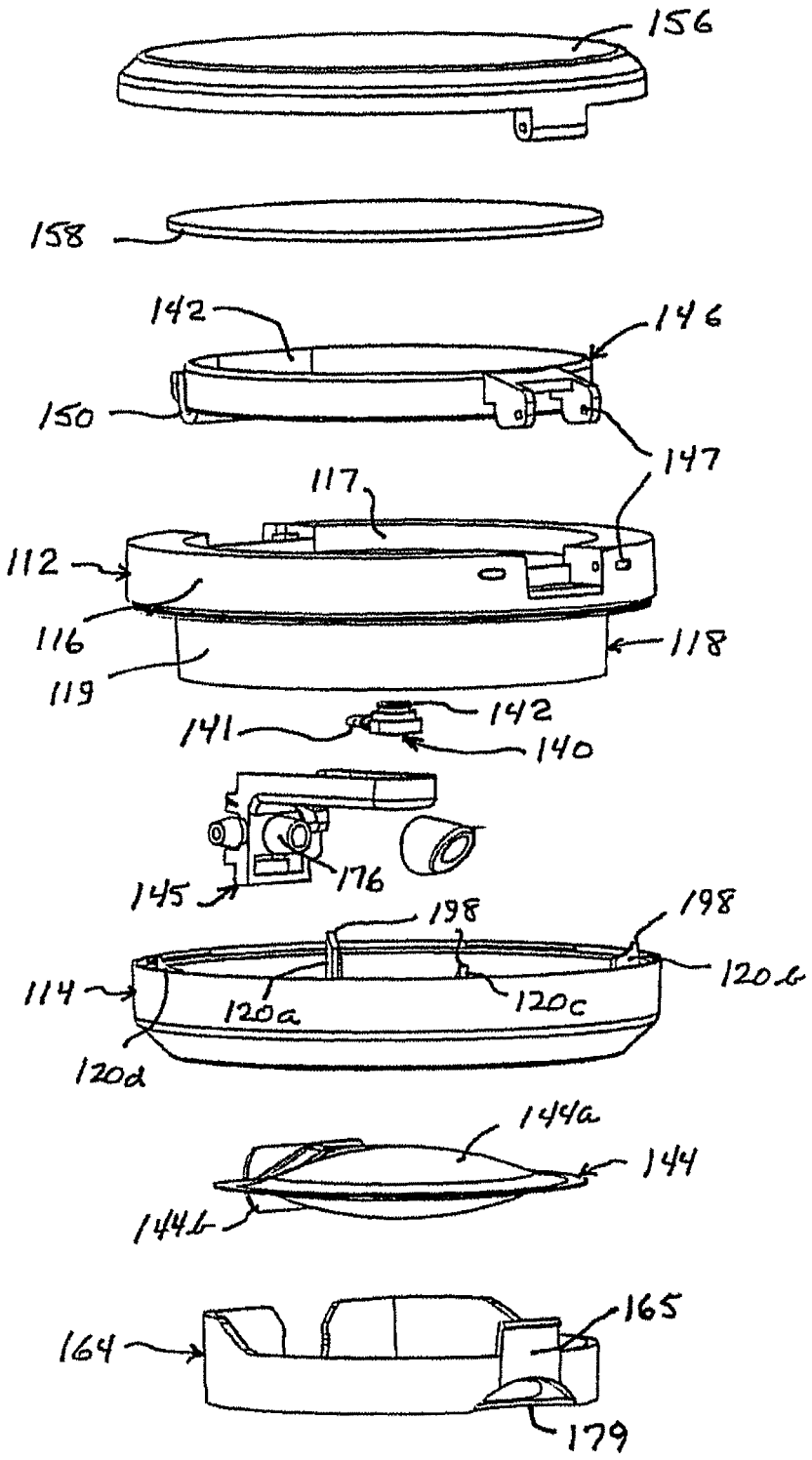
FIG. 27 is an exploded side view of the compact of FIG. 15.

The continuing rotation of wall 114 relative to wall 119 carries the new seal 130*d* downstream along the tube beyond the inlet end 136, causing a further progressively elongating tube open region 132*c* to open between seal 130*d* and the tube inlet end, again creating a vacuum, which draws a quantity of fluid product 134*c* from cartridge 144 into region 132*c* (FIG. 25). Then, another rib 120*c* advances into engagement with tube 128 at the inlet end; another seal 130*c* is created in the tube, followed (as rib 120*c* advances) by another internally open region 132*b*, filled in its turn by a quantity 134*b* of fluid product from the cartridge 144, while the discrete product quantities 134*d* and 134*c* are moved, by the advancing ribs 120*d* and 120*c*, toward the tube outlet end 138. As rib 120*b* follows, seal 130*b* and internally open tube region 132*a* are created, and region 132*a* is filled with discrete product quantity 134*a* (FIG. 26).

In this way, by simple manual rotation of the bottom body part 114 relative to the top body part 112, successive discrete quantities 134*d*-134*a* of fluid product each in an enclosure (regions 132*d*-132*a*) provided by the tube and the crimped, moving seals 130*d*-130*a*, are advanced by the moving ribs 120*d*-120*a* from the inlet end to the outlet end of the tube. At the outlet end, the rotary movement of the ribs forces these discrete product quantities (doses) in succession out through the nozzle 142 into the pan 117, flapper 146 (along with lid 156) having been opened to remove the pintle 148 from the nozzle.

While filling of the pan 117 with four successive doses of fluid cosmetic product has been described, the user may terminate such filling after less than four doses have been delivered, or continue filling the pan with additional doses 134*d*, 134*c*, etc., by further rotating bottom body part 114 relative to top body part 112. When the pan has been filled with the selected number of doses, the user, employing the sponge applicator (conveniently available in the flapper cavity 152) if desired, picks up the dispensed fluid product from the pan and, with the aid of mirror 158 on the lid, applies it to the skin. This procedure may be repeated, for successive applications of the fluid product, as long as there is a dispensable amount of product in the cartridge 144.

The cartridge includes a flexible, collapsible pouch 144*a* and is adapted to discharge fluid product into the tube each time a vacuum is created at the tube inlet end by a moving rib 120*a*, 120*b*, 120*c* or 120*d* as described above, until the body of fluid product it contains is at least substantially exhausted. As fluid product is drawn from the flexible pouch 144*a*, the pouch is progressively evacuated and consequently progressively collapsed by ambient atmospheric pressure acting on the exterior of the pouch; i.e., the differential between external ambient pressure and the vacuum created at the tube inlet end by an advancing rib 120*a*, 120*b*, 120*c* or 120*d* acts to force remaining fluid product from the pouch into an internally open region 132*a*, 132*b*, 132*c* or 132*d* of the tube until the next advancing rib crimps the tube to form another seal 30 at the inlet end.

Again as in the case of compact 10, once the compact 110 begins to be used, and the initial amount desired for an application has been dispensed, a succession of discrete quantities 134*a*, 134*b*, 134*c*, 134*d* of the product will remain standing in the tube (see FIG. 26), each individually contained within a region 132*a*, 132*b*, 132*c* or 132*d* of the tube closed at both ends by seals 130*a*, 130*b*, 130*c* and 130*d*. Between applications, the nozzle 142 is sealed by the pintle. The enclosed product quantities in the tube are protected from exposure to the atmosphere or other contact with air, owing to the tube walls and the maintained seals 130*a*, 130*b*, 130*c* and 130*d* at each end of each product-filled region 132*a*, 132*b*, 132*c* or 132*d*. The remaining body of product in the cartridge 144 is also protected from the atmosphere because the cartridge is itself sealed as is the connection of the cartridge to the tube, and the succession of seals 130*a*-130*d* within the tube prevents any access of air to the cartridge through the tube.

The cartridge further includes a rigid plastic component 144*b* having a nozzle 144*c* sealingly secured to the flexible pouch and insertable therewith into a cartridge holder or baseplate 164 that seats removably in portion 118 of the top body part 112 so that the cartridge rotates with the top body part and the tube 128 relative to the bottom body part 114. A tab/slot arrangement 165 is provided to position and secure the baseplate 164 in portion 118 at the bottom of the compact. When empty, the cartridge is removed (as facilitated by notch 179) and replaced with a refill cartridge, which is placed in the baseplate; the user then slides the baseplate into the bottom of the compact to engage an intake nozzle 176 mounted in portion 118 with the nozzle 144*c* of component 144*b*, and snaps the cartridge in place to keep it pushed forward and the seal between nozzles 144*c* and 176 maintained while defining a passage therethrough for fluid product. The intake nozzle also has a non-return ratchet that engages and blocks the ribs 120*a*-120*d* if the bottom body part 114 is rotated in the wrong direction relative to top body part 112, in order to prevent air from being accidentally pumped back into the system. When the body parts undergo relative rotation in the proper direction, i.e. the direction of arrow 160, the ratchet deflects out of the way of the ribs.

In the compact 110, as compared to the compact 10, owing to changes in overall compact geometry, the intake nozzle is thinner and the pouch nozzle wider, hence easier to fill. The pouch volume has also been increased by giving it a wider area and incorporating gussets (folds in the pouch material) along the pouch bottom and sides.

Since the inlet and outlet ends of tube 128 in the compact 110 are substantially in the same angular position relative to the compact periphery (FIG. 21), rather than being 180° apart as in compact 10, the tube extends almost 360° around the compact, and the length of each individual product-containing region 132*a*, 132*b*, 132*c* and 132*d* is nearly twice as long as that in compact 10, for a given number of such regions that can simultaneously contain product (and a given compact diameter); hence the volume of each individual "dose" is correspondingly increased. In general, the fewer the number of ribs, the less is the surface friction, which makes for smoother dispensing and helps avoid forward creep of the tube toward the outlet nozzle. Increase in individual dose volume reduces the number of turns required to dispense a given amount of product desired for one application.

Figure 28:
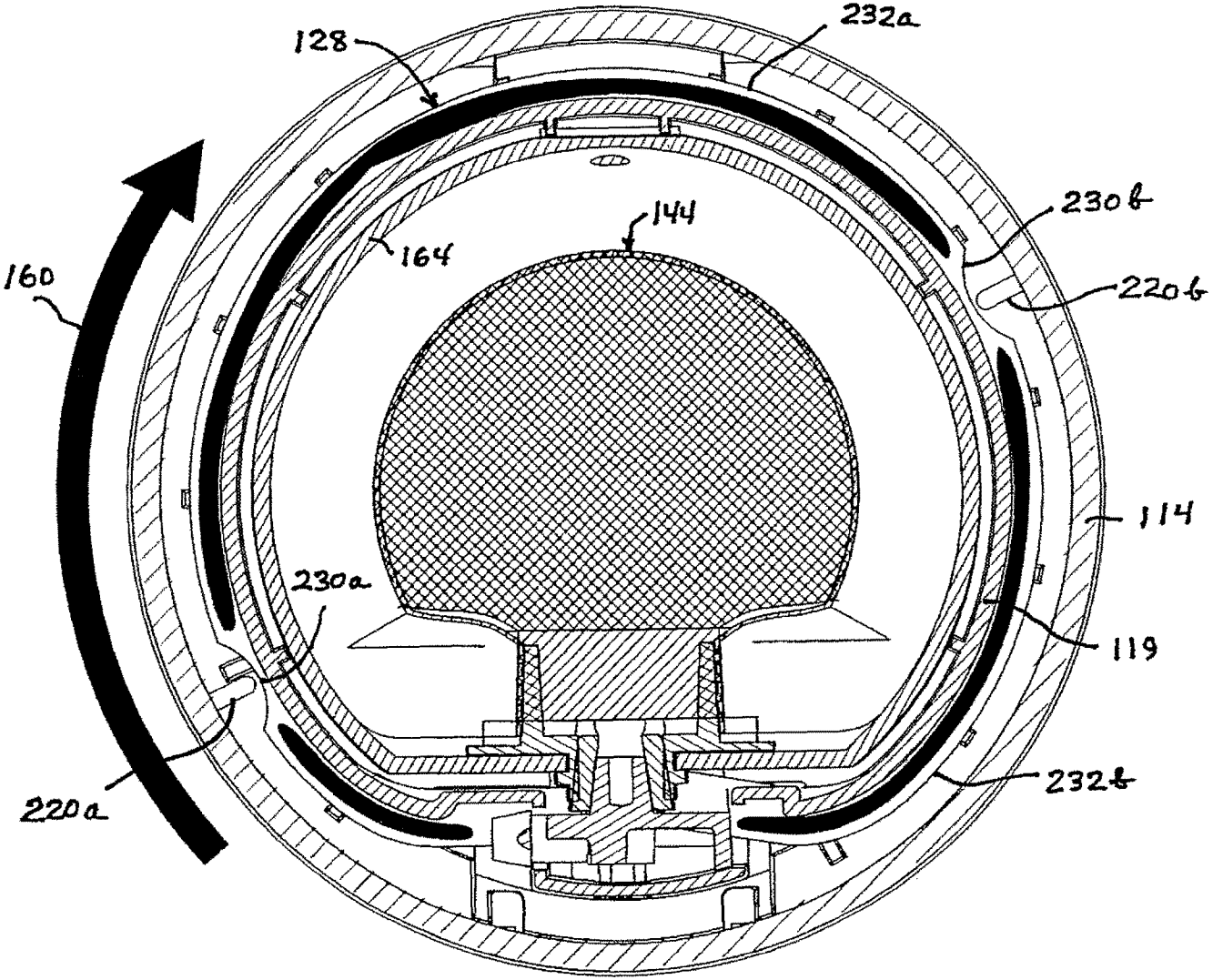
FIGS. 28 and 29 are views similar to FIG. 26 of two additional modified embodiments of the invention.
Figure 30:
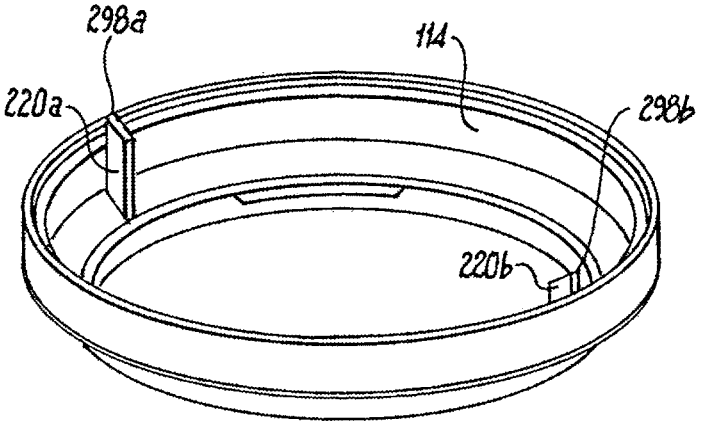
FIGS. 30 and 31 are perspective views of the bottom body parts of the embodiments of FIGS. 28 and 29, respectively.

Although four ribs 120*a*-120*d* are included in the compact 110 as shown, the number of ribs can be reduced to three (spaced 120° apart) or even two (spaced 90° apart) by simply modifying the number and position of ribs formed in the bottom body part 114. Two is the minimum number of ribs required to maintain one sealed dose and one vacuum dose as needed for airless dispensing (prevention of air ingress into the package). A two-rib embodiment of the compact of the invention, otherwise essentially identical to the embodiment of FIGS. 15-27, is shown in FIGS. 28 and 30, in which the ribs are respectively identified as 220*a* and 220*b* (creating seals 230*a* and 230*b* and un-crimped regions 232*a* and 232*b* in the tube) with other elements and features being the same as illustrated in FIG. 26 and described above. Three ribs (as compared to two) offers the advantage of an additional rib to ensure failsafe airless operation in the event that one of the ribs does not fully compress the tube. If desired, to further reduce rib-tube friction, a small amount of lubricant may be added to the tube surface.

Another difference between the compacts 10 and 110 is in the arrangement for snap-fitting connection of the top and bottom body parts. In each compact, an outer circular lip on the rim of one interfits with an inner circular flange on the rim of the other. For reasons of tooling, in the compact 110 it is convenient to form the outer circular lip 194 on the rim of the bottom body part 114 and the inner circular flange 196 on the rim of the top body part skirt 116*a*. Hence, when the tube 128 is compressed by ribs 120*a*-120*d* and pushes back outward through the ribs against the bottom body part 114, the top body part does not counteract this outward force (as it does in the compact 10, where the lip 94 is formed on the top body part 12 outwardly of the flange 96 on the bottom body part 14, see FIGS. 8-9), with the result that the snap-fitting connection of the top and bottom body parts may not be maintained, and indeed the tube 128 may not be compressed as needed to provide seals 130*a*-130*d*. To prevent this, in the compact 110 the ribs are increased in height as indicated at 198 in FIGS. 22 and 27, projecting above wall 114 to engage the inner surface of skirt 116*a* of top body part 112, which resists the outward pushing force of the compressed tube. The upward projections 198 of the ribs are disposed and dimensioned for snap-fitting engagement of the array of rib projections with the inner surface of the skirt 116*a*. The described arrangement of rib projections and skirt also helps prevent the tube from being pushed between, and possibly separating, the top and bottom body parts. As illustrated in FIG. 30, ribs 220*a* and 220*b* of the FIG. 28 compact have portions 298*a* and 298*b* that project above wall 114 in the same way, and for the same purpose, as the aforementioned projections 198 of ribs 120*a*, 120*b*, etc.

Figure 29:
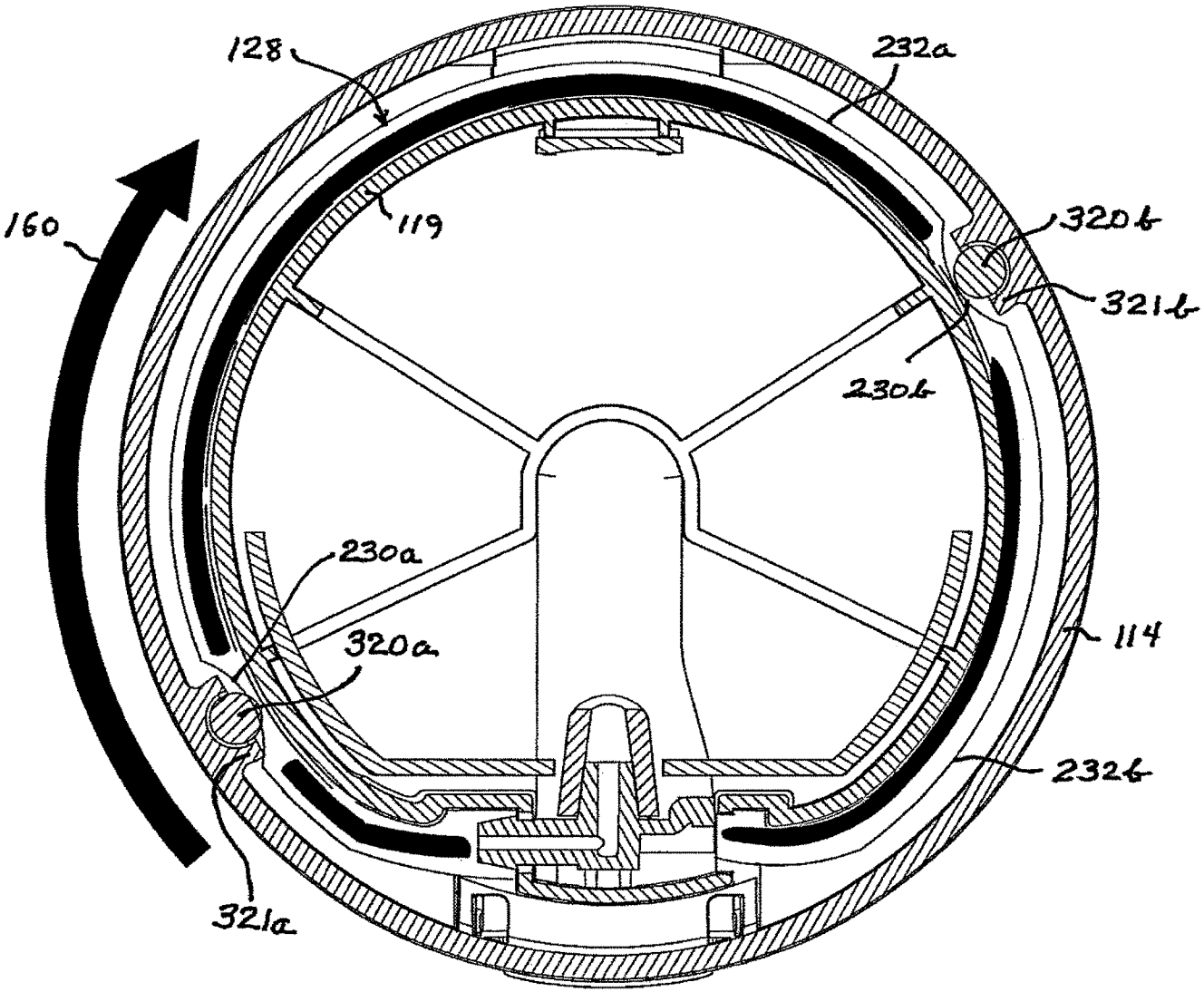
Figure 31:
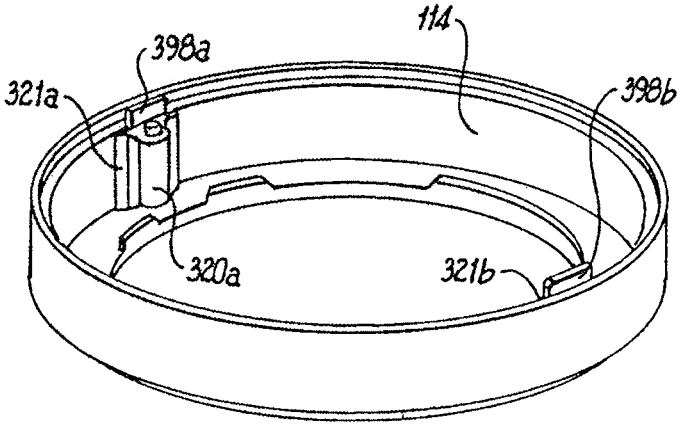

FIGS. 29 and 31 show a modification of the two-rib FIG. 28 structure, in which the ribs 220*a* and 220*b*, molded integrally with the bottom body part or outer wall 114, are replaced by ribs in the form of rollers 320*a* and 320*b* and associated brackets 321*a* and 321*b* (the brackets being secured to the inner surface of wall 114 or molded integrally with the wall) mounting the rollers for rotation about their vertical axes. In the structure of FIGS. 29 and 31, the projecting rib portions 298*a* and 298*b* of the FIG. 28 compact (and their function) are replaced by upward projections 398*a* and 398*b* above the brackets 321*a* and 321*b*. In embodiments having three or more ribs, e.g. the compacts 10 and 110 of FIGS. 1 and 15, respectively, like roller-and-bracket ribs can also be employed in place of the rigid ribs 20 and 120 (molded integrally with wall 14 or 114) described above.

Advantages of the invention, in addition to those mentioned above, include the low number of parts and ease of assembly as compared to a separate airless push pump; minimal points to seal, reducing risk of leakage; and avoidance of product contamination from pump components (because the product is contained only in tubing), airless dispensing in a compact format, ease of modifying dose volume, no forceful sealing of the lid (with the ability to use any industry-standard closure), ergonomic and intuitive action, and the provision of space for a standard sponge.

Figure 32:
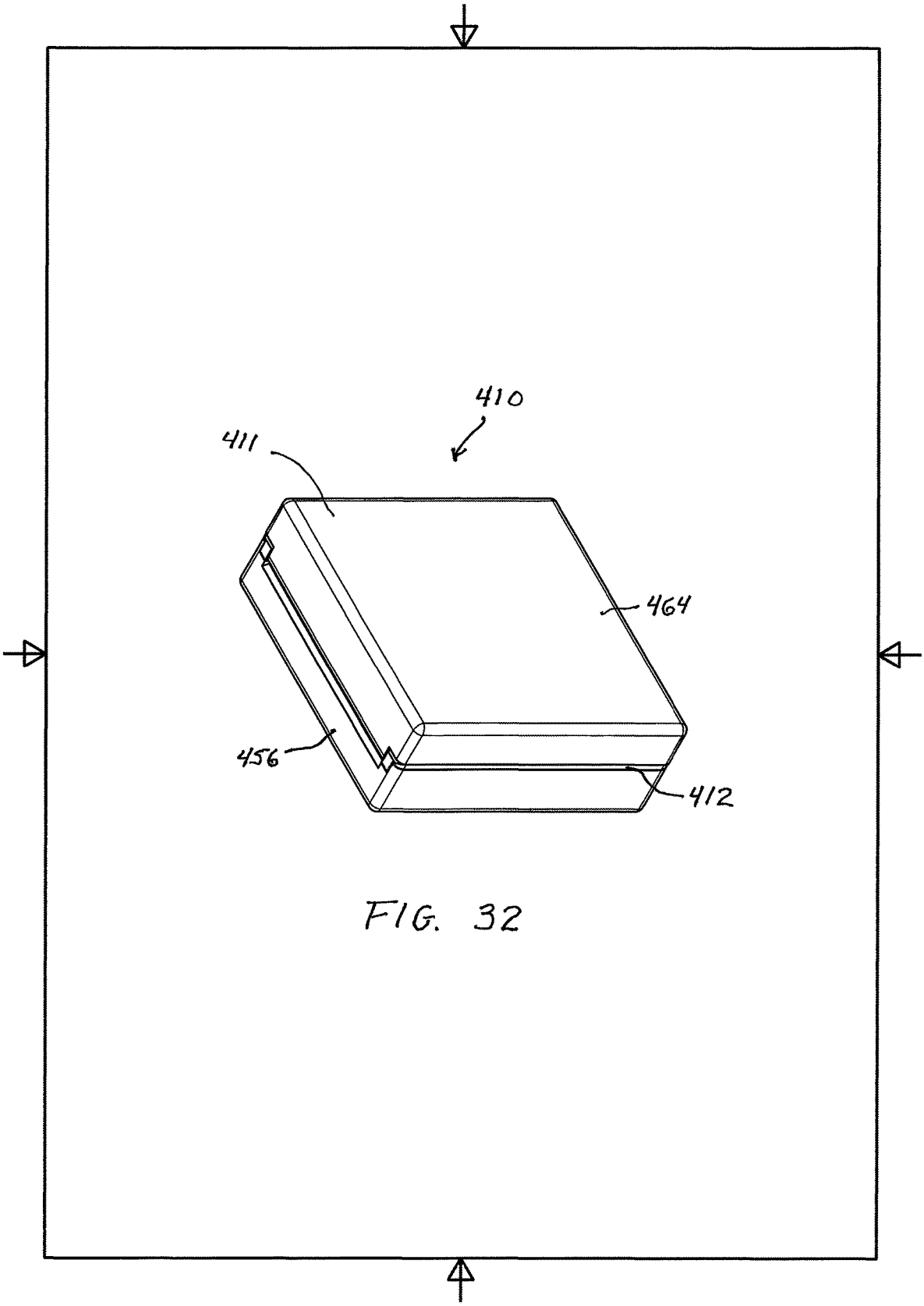
FIG. 32 is a perspective view of a further embodiment of the rotary airless compact of the present invention.

A still further embodiment of the compact of the invention is illustrated in FIGS. 32-39. The compact 410 there shown differs from the embodiments of FIGS. 1-31 in that the concentrically disposed annular outer wall 414 and the arcuate (here also annular) inner wall 419, together with the soft flexible hollow tube 428 extending between them, are enclosed within a rigid (e.g. molded plastic) outer housing 411 constituted of a central platform 412, a pivotally openable lid 456 enclosing the inner and outer walls and mounted by hinges 457 on one side of the platform, and a slidably removable baseplate 464 fitted and clipped to the platform on the side thereof opposite the lid. The lid, platform and baseplate, when fully assembled as shown in FIG. 32, together form a flat-sided three-dimensional figure, conveniently or preferably a rectangular-solid figure which is square in plan view (when oriented with its major surfaces in horizontal planes). Other differences between the compact of FIGS. 32-38 and the embodiments of FIGS. 1-31 will be described below.

The rigid annular inner wall 419 laterally surrounds and defines an upwardly opening pan 417 for receiving and holding cosmetic product for access by a user. A pan floor 422, having a product delivery hole 424, is disposed within the wall 419; the wall and the pan floor are substantially centered in, and molded integrally with or otherwise fixedly mounted in, the platform 412, which extends outwardly of the wall 419 on all sides and has a square periphery. An upwardly opening annular channel or groove 429, formed in the platform 412, concentrically surrounds and exposes the outer surface of wall 419 to a depth below the pan floor, being dimensioned to receive the outer annular wall 414 (in surrounding concentric relation to the wall 419) and to accommodate the tube 428 between the two walls. The platform (including pan floor 422) and the baseplate 464 define a space 426 below the pan within the housing 411.

Figure 34:
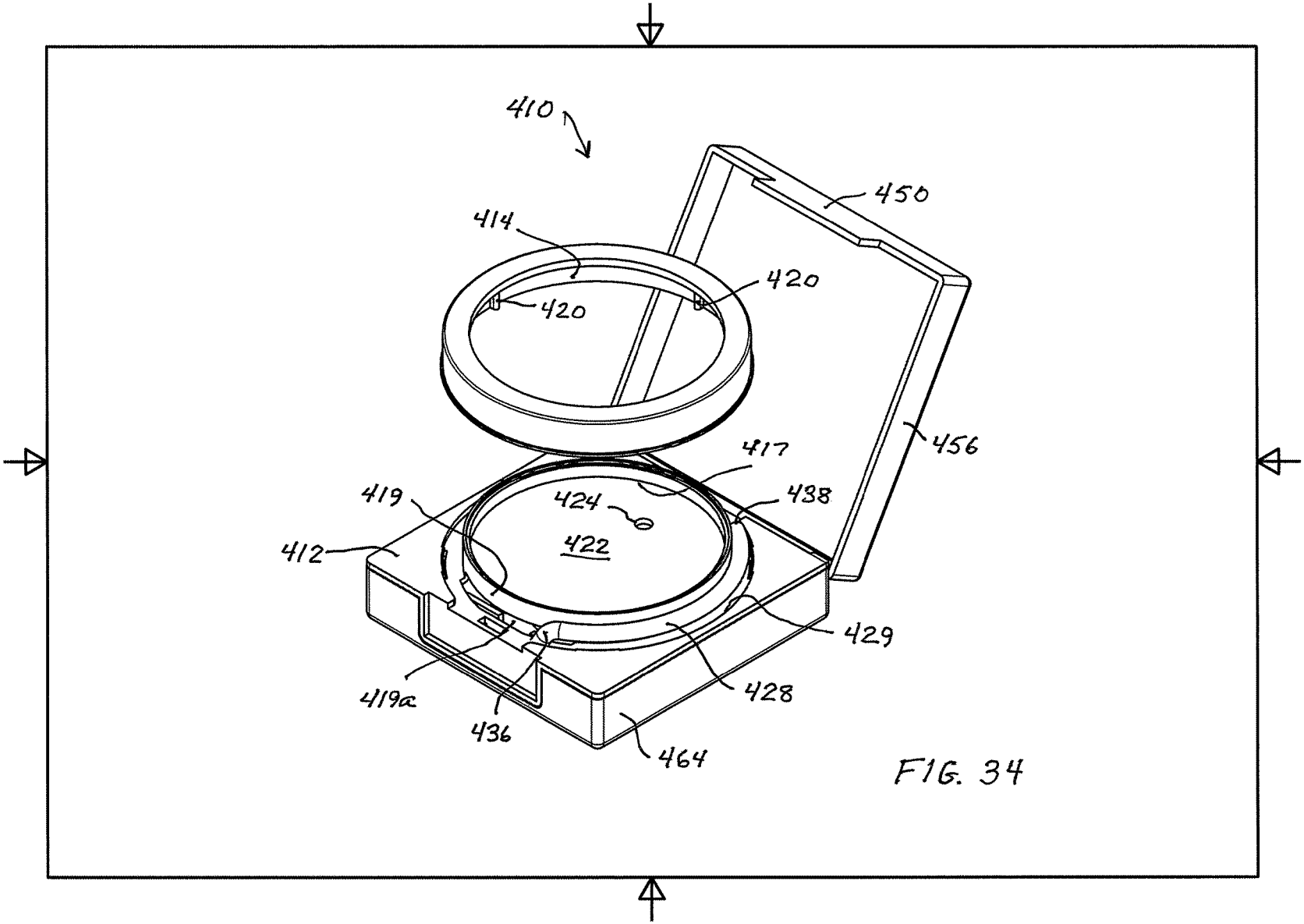
FIG. 34 is a partially exploded perspective view similar to FIG. 33, but showing the tube assembled with the platform including the inner wall.

When mounted as shown in FIG. 34, the tube 428 is secured in fixed relation to the inner wall 419 and serves to convey fluid cosmetic product, from a replaceable flexible pouch cartridge 444 mounted in the baseplate 464 within space 426, through an arcuate path of about 180° around the outer surface of wall 419 in groove 429 to the product delivery hole 424, and thence into the pan 417. Thus, the inlet end 436 of the tube is connected to the cartridge 444 and the outlet end 438 of the tube is arranged to communicate with the hole 424 on the underside of the pan floor 422, also in space 426. To this end, the lower portion of the wall 419, which extends downwardly into the space 426 below the pan floor, has openings 419*a* and 419*b* between the groove and the space 426 at locations about 180° apart around the wall (respectively at the front and the rear of the compact), through which the opposed inlet end 436 and outlet end 438 of the tube 428 in groove 429 are respectively inserted. The platform, including the inner wall and the pan floor, may conveniently be fabricated as a unitary, integral, generally rigid molded plastic article.

Figure 35:
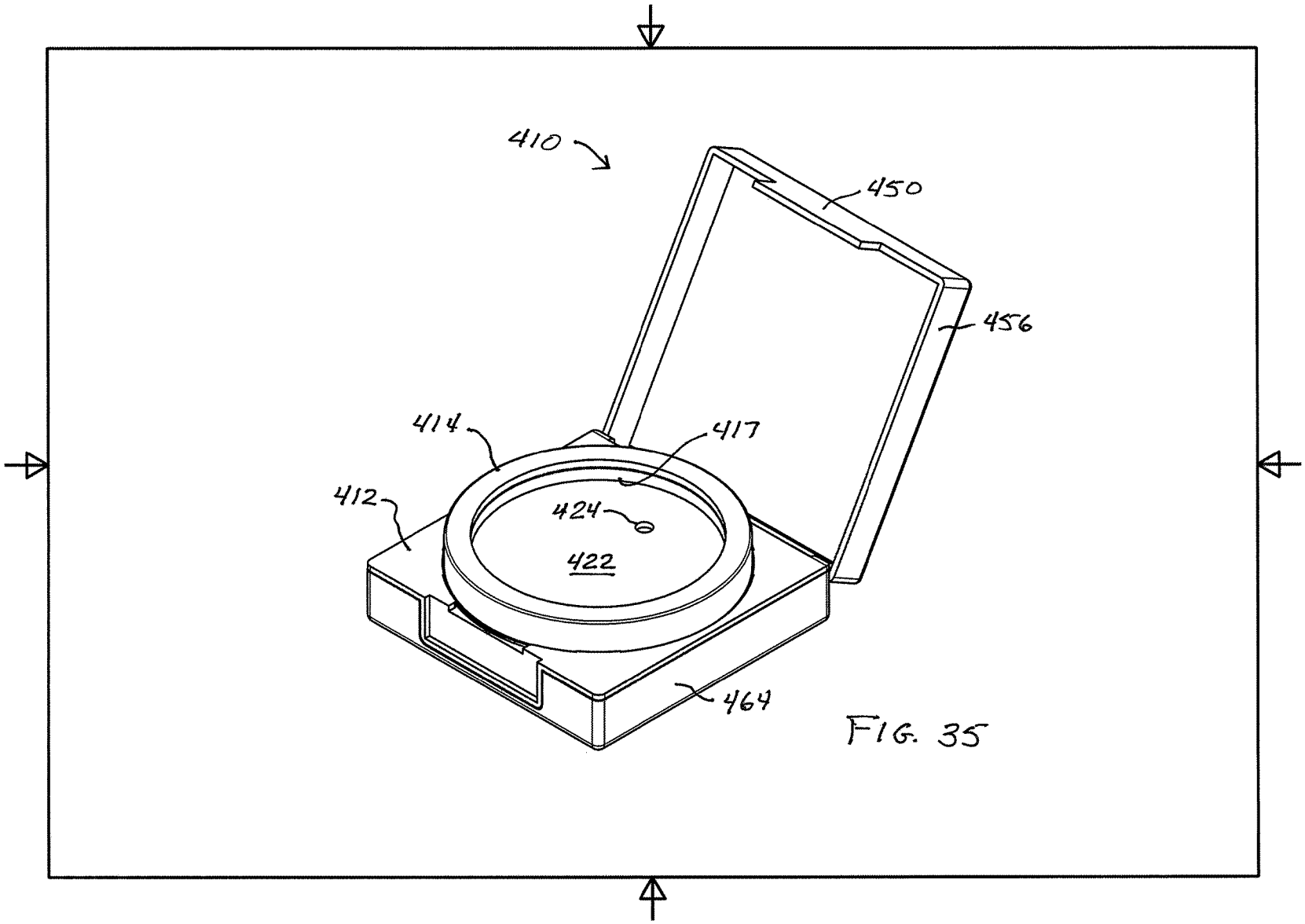
FIG. 35 is a partially exploded perspective view similar to FIG. 34 but showing the outer wall assembled with the platform.
Figure 36:
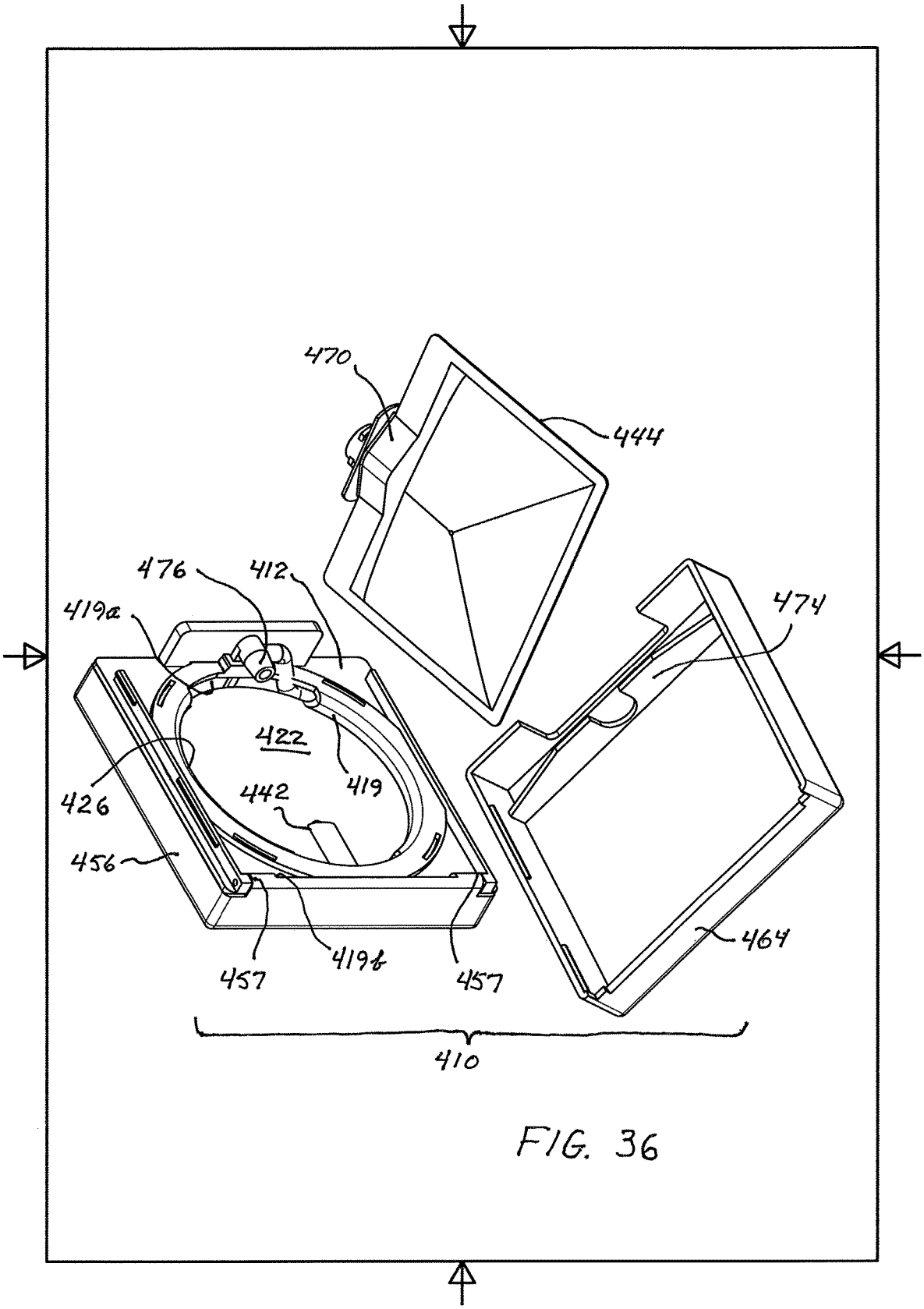
FIG. 36 is a partially exploded perspective view similar to FIG. 32 but showing the cartridge and baseplate separated from each other and from the platform and lid.
Figure 37:
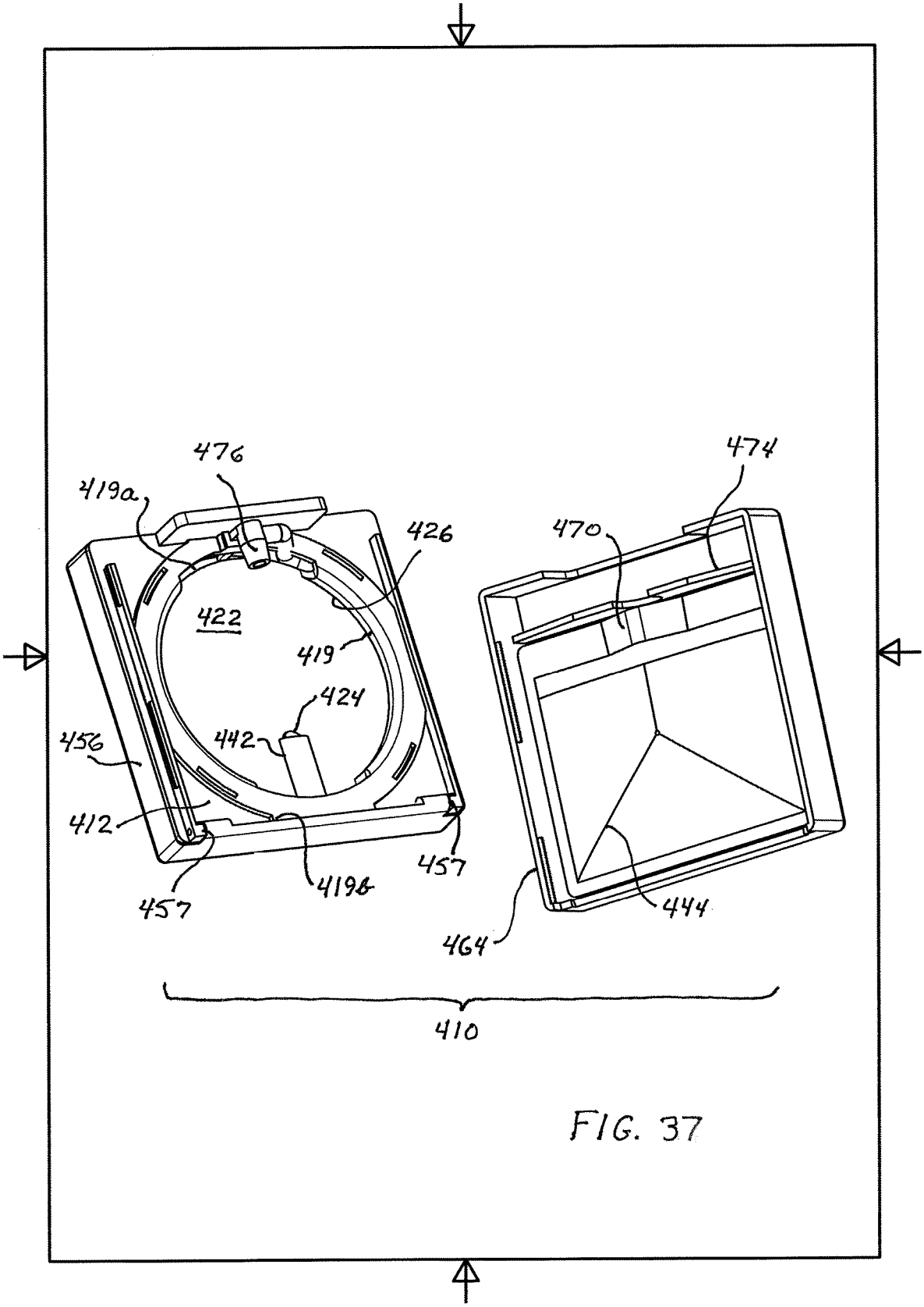
FIGS. 37, 38 and 39 are views similar to FIG. 32 illustrating successive steps in the installation of the baseplate on the platform.
Figure 38:
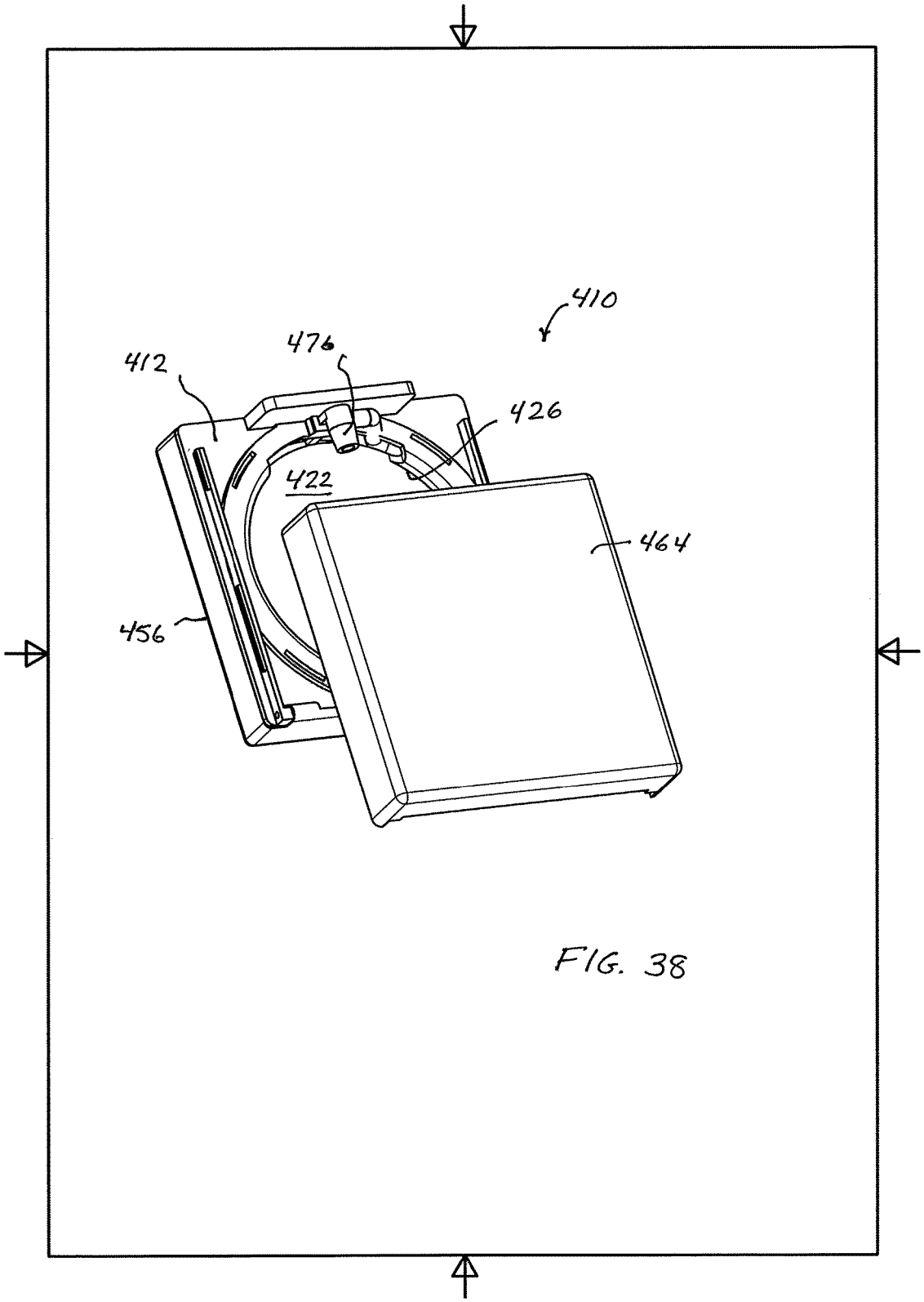
Figure 39:
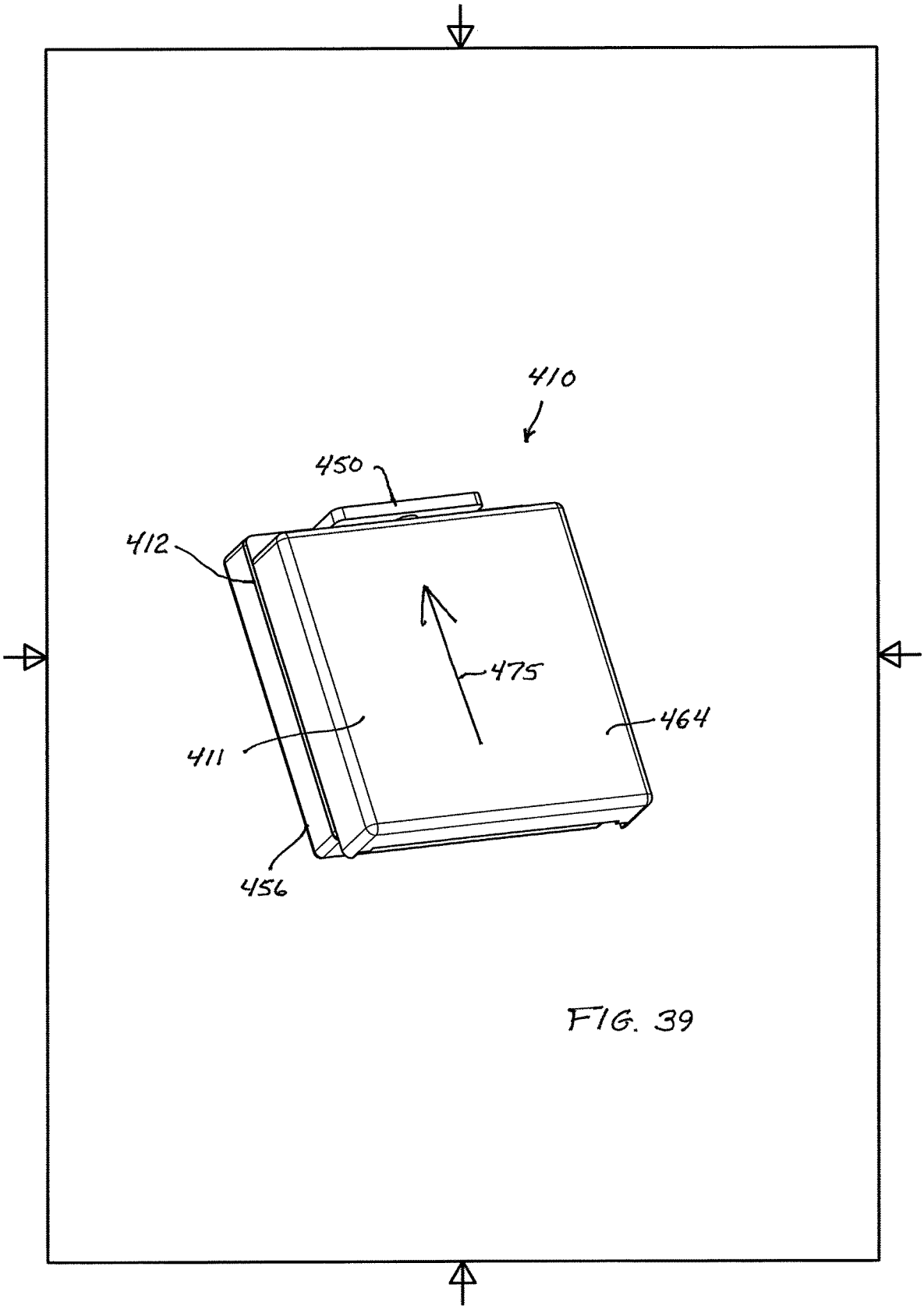

The outer annular wall 414 is a rigid (e.g. molded plastic) ring dimensioned to fit rotatably within the groove 429 of the platform 412, in surrounding relation to the inner wall 419 and the flexible tube 428. The inner surface of this wall or rotation ring 414 is cylindrical and bears a plurality of integrally formed inwardly projecting vertical ribs 420 (equidistantly spaced 90° apart around the ring, in the showing of FIGS. 33 and 34). When the ring 414 is mounted as shown in FIG. 35 within the groove 429 for rotation relative to the annular wall 419 and tube 428, its cylindrical outer surface projects above the upper surface of platform 412 so as to be manually graspable by a user, enabling the user to pump cosmetic product from the pouch cartridge 444 into the pan 417 through the tube 428 by rotating the ring 414 with one hand while holding the conjoined platform 412 and baseplate 464 stationary with the other hand. To facilitate grasping, the outer surface of the ring may be roughened as with serrations.

The pumping of fluid product from the cartridge to the pan through the tube is effected in the same way as in the above-described embodiments of FIGS. 1-31. With the lid open, the ring or outer wall 414 is rotated (counterclockwise, in the view of FIGS. 33 and 34), causing the ribs 420 to pass in succession along the tube 428, locally compressing and thereby crimping the tube against the inner wall 419 at spaced localities to form spaced local seals that advance, one after the other, along the length of the tube (as the ribs advance), from the inlet end to the outlet end of the tube. Between successive crimped seals are un-crimped regions of the tube, advancing as the ribs and seals advance. As a rib engages the tube adjacent the inlet end thereof and advances toward the outlet end, the pressure within the un-crimped tube region that opens behind the rib is substantially a vacuum; hence, ambient air pressure acting on the exterior of the flexible pouch cartridge 444 in space 426 forces fluid cosmetic product from the cartridge into this un-crimped region until the next advancing rib crimps the tube adjacent the inlet end and thereby closes the trailing end of the product-filled un-crimped region (with ribs spaced 90° apart along the ring, the leading end of the latter product-filled region has not yet arrived at the tube outlet end). As the ring 414 continues to rotate, the ribs continue to advance the product-filled un-crimped region along the tube toward the hole 424, ultimately delivering a discrete quantity of product to the pan. This described procedure is repeated until a desired total amount of product has been received in the pan for pick-up and application to a user's skin with an applicator.

For installation or replacement of the flexible pouch cartridge 444, the baseplate 464 is slid longitudinally out of engagement with the platform, and the spent cartridge (if any) is removed manually. A new, full cartridge having a hard spout 470 is fitted into pouch-holder structure 474 in the baseplate (FIG. 38), which is then slid (arrow 475, FIG. 39) and clipped into closed position, whereupon the nozzle spout mates with an intake nozzle 476 in the space 426 in the platform; the nozzle 476 communicates with the inlet end of the tube so that cosmetic product from the pouch passes into the tube as described above during operation of the compact.

As shown, the pouch may advantageously be square or rectangular, substantially entirely filling the area within square baseplate 464, as this increases the volume of product that can be held in the compact and also simplifies pouch manufacture.

Figure 33:
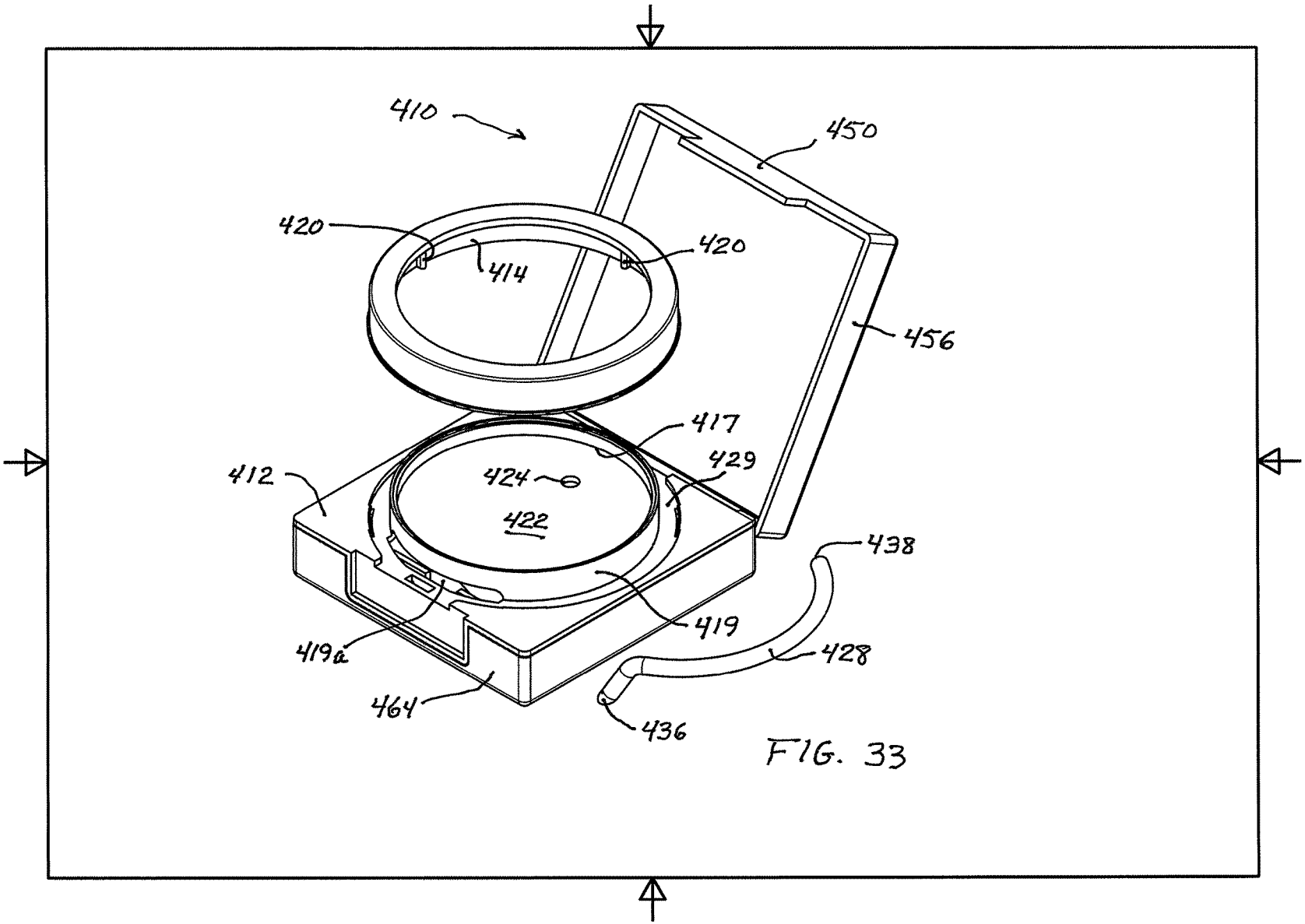
FIG. 33 is an exploded perspective view of the compact of FIG. 32, with the lid raised.

Other features of the compact of FIGS. 32-39 may correspond to those of the embodiments of FIGS. 1-31. Thus, the compact may include an arrangement for limiting rotation of the ring 414 (relative to the wall 419) to the one direction in which fluid cosmetic product is advanced from the inlet end to the outlet end of the tube 428 (i.e., counterclockwise as seen in FIGS. 33-34). Any suitable form of clip latch 450 may be used to secure the lid to the platform. Any appropriate arrangement or means (such as an output nozzle 442) may be provided for connecting the tube outlet end 438 to the hole 424 or for conducting fluid cosmetic product from the tube outlet end to the hole. A mirror (not shown) may be mounted on the inner surface of the lid.

An advantage of the embodiment of FIGS. 32-39 is that, because the ring or wall 414 is entirely enclosed between the lid and platform when the lid is latched, cosmetic product cannot be pumped when the lid is closed. The rectangular/square compact configuration simplifies the manipulation of the compact and baseplate for refill operation, improves the strength of the lid hinge and clip, and makes the components easier to mold. The flat-sided housing also enhances the ease of gripping the compact body during pumping rotation of the annular wall 414.

It is to be understood that the invention is not limited to the features and embodiments hereinabove set forth, but may be carried out in other ways without departure from its spirit.

What is claimed is:

1. A rotary airless compact for a fluid cosmetic or skin care products, comprising:

a compact body defining a pan area and including an arcuate inner wall and an annular outer wall disposed in facing concentric relation and manually rotatable relative to each other;

a flexible tube extending between the walls, secured to the inner wall and having first and second ends with means adjacent the second end, communicating with the pan area, for dispensing fluid product from the tube into the pan area;

a supply pouch for fluid product communicating with a first end of the tube, wherein the outer wall bears spaced radial ribs projecting inwardly to crimp the tube at spaced locations against the inner wall, providing successive seals between which the tube has internally open regions for holding product, such that as the outer wall rotates relative to the inner wall in a direction from the first end toward the second end of the tube, product is drawn from the supply pouch at the first end into successive open regions in discrete quantities separated by the seals, and the ribs advance the seals and open regions to the second end, where the dispensing means discharges the quantities of product into the pan area; and a platform fixedly attached to the inner wall and extending outwardly around the inner wall, wherein the inner wall surrounds and laterally defines the pan area, which has a pan floor fixedly connected to the inner wall, and wherein the outer wall is rotatably mounted on the platform in spaced and surrounding concentric relation to the inner wall and is manually graspable and rotatable relative to the platform and the inner wall, with the tube disposed between the walls so as to be crimped against the inner wall by the ribs as aforesaid.

2. A compact as defined in claim 1, further including a lid connected to the platform and defining therewith an enclosure surrounding the inner and outer walls and the pan area, the lid being movable between closed and open positions.

3. A compact as defined in claim 2, further including a removable baseplate slidably connected to the platform on a side of the platform opposite the lid and defining with the platform a space below the pan area, wherein the supply cartridge is a flexible cartridge in sealed connection with the first end of the tube, is exposed externally to atmospheric pressure so that it collapses progressively as it is evacuated by withdrawal of fluid product into the tube, and is replaceably mounted in the baseplate within said last-mentioned space.

4. A compact as defined in claim 3, wherein said platform, said lid and said baseplate when assembled in closed relation to each other cooperatively define a housing of generally rectangular configuration entirely enclosing said inner and outer walls, said tubing, said pan area and said cartridge.

5. A compact as defined in claim 3, wherein said platform has an annular groove concentrically surrounding said inner wall, for receiving said tube and said outer wall and in which the outer wall is mounted for rotation around said inner wall.

6. A compact as defined in claim 5, wherein the first and second ends of the tube extend downwardly through apertures in the platform about 180° apart into the space below the pan area, respectively for connection with the cartridge and for communication with the pan area.

* * * * *